US007961165B2

(12) United States Patent
Shimoshikiryoh

(10) Patent No.: US 7,961,165 B2
(45) Date of Patent: Jun. 14, 2011

(54) LIQUID CRYSTAL DISPLAY DEVICE AND METHOD FOR DRIVING THE SAME

(75) Inventor: Fumikazu Shimoshikiryoh, Matsusaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 819 days.

(21) Appl. No.: 10/924,889

(22) Filed: Aug. 25, 2004

(65) Prior Publication Data

US 2005/0062904 A1 Mar. 24, 2005

(30) Foreign Application Priority Data

Aug. 25, 2003 (JP) ..... 2003-300177
Aug. 9, 2004 (JP) ..... 2004-232455

(51) Int. Cl.
*G09G 3/36* (2006.01)

(52) U.S. Cl. ..... 345/94; 345/90

(58) Field of Classification Search ..... 345/89, 345/87, 94, 96, 103, 208–210, 90; 349/39
See application file for complete search history.

(56) References Cited

U.S. PATENT DOCUMENTS 4,345,249 A 8/1982 Togashi
5,173,687 A 12/1992 Tanaka et al. ..... 340/784
5,583,531 A 12/1996 Okada et al.
5,774,099 A * 6/1998 Iwasaki et al. ..... 345/87
6,421,039 B1 * 7/2002 Moon et al. ..... 345/98
6,486,864 B1 * 11/2002 Nakajima et al. ..... 345/100
7,136,057 B2 * 11/2006 Senda et al. ..... 345/87
2001/0006410 A1 7/2001 Yamada et al.
2001/0024257 A1 9/2001 Kubo et al.
2001/0026283 A1 10/2001 Yoshida et al.
2002/0097362 A1 7/2002 Yamada et al.

FOREIGN PATENT DOCUMENTS

EP 1 113 312 A2 7/2001
JP 62-267725 11/1987
JP 05-094153 4/1993
JP 2003-177725 6/2003

* cited by examiner

*Primary Examiner* — Chanh Nguyen
*Assistant Examiner* — Allison Walthall
(74) *Attorney, Agent, or Firm* — Harness, Dickey & Pierce, P.L.C.

(57) ABSTRACT

A liquid crystal display device includes a plurality of pixels, each of which includes a liquid crystal capacitor made up of a liquid crystal layer and two electrodes to apply a voltage to the liquid crystal layer. While the device is conducting a display operation, an oscillation voltage, which oscillates a number of times within a single vertical scanning period, and a predetermined gray-scale voltage are applied to the liquid crystal capacitor of an arbitrary one of the pixels.

12 Claims, 15 Drawing Sheets

| EVCLCave | Vaddpp |
|---|---|
| 0 | K × VCSpp |
| 0 | K × VCSpp |
| 0 | K × VCSpp |
| 0 | K × VCSpp |
| 0 | K × VCSpp |
| 0 | K × VCSpp |
| 0 | K × VCSpp |
| 0 | K × VCSpp |

| EVCLCave | Vaddpp |
|---|---|
| 0 | K × VCSpp |
| 0 | K × VCSpp |
| 0 | K × VCSpp |
| 0 | K × VCSpp |
| 0 | K × VCSpp |
| 0 | K × VCSpp |
| 0 | K × VCSpp |
| 0 | K × VCSpp |

LIQUID CRYSTAL DISPLAY DEVICE AND METHOD FOR DRIVING THE SAME

This Nonprovisional application claims priority under 35 U.S.C. § 119(a) on Patent Application Nos. JP 2003-300177 filed Aug. 25, 2003 and JP 2004-232455 filed on Aug. 9, 2004, the entire contents of each of which are hereby incorporated herein by reference.

BACKGROUND OF THE INVENTION

1. Field of the Invention

The present invention relates to a liquid crystal display device and a method for driving the device.

2. Description of the Related Art

A liquid crystal display (LCD) is a flat-panel display that has a number of advantageous features including high resolution, drastically reduced thickness and weight, and low power dissipation. The LCD market has been rapidly expanding recently as a result of tremendous improvements in its display performance, significant increases in its productivity, and a noticeable rise in its cost effectiveness over competing technologies.

A twisted-nematic (TN) mode liquid crystal display device, which used to be used extensively in the past, is subjected to an alignment treatment such that the major axes of its liquid crystal molecules, exhibiting positive dielectric anisotropy, are substantially parallel to the respective principal surfaces of upper and lower substrates and are twisted by about 90 degrees in the thickness direction of the liquid crystal layer between the upper and lower substrates. When a voltage is applied to the liquid crystal layer, the liquid crystal molecules change their orientation direction into a direction that is parallel to the electric field applied. As a result, the twisted orientation disappears. The TN mode liquid crystal display device utilizes variation in the optical rotatory characteristic of its liquid crystal layer due to the change of orientation directions of the liquid crystal molecules in response to the voltage applied, thereby controlling the quantity of light transmitted.

The TN mode liquid crystal display device allows a broad enough manufacturing margin and achieves a high productivity. However, the display performance (e.g., the viewing angle characteristic, in particular) thereof is not fully satisfactory. More specifically, when an image on the screen of the TN mode liquid crystal display device is viewed obliquely, the contrast ratio of the image decreases significantly. In that case, even an image, of which the grayscales ranging from black to white are clearly observable when the image is watched straightforward, loses much of the difference in brightness between those grayscales when viewed obliquely. Furthermore, the grayscale characteristic of the image being displayed thereon may sometimes invert itself. That is to say, a portion of an image, which looks darker when viewed straight, may look brighter when viewed obliquely. This is a so-called "grayscale inversion phenomenon".

To improve the viewing angle characteristic of such a TN mode liquid crystal display device, an inplane switching (IPS) mode liquid crystal display device (see Japanese Patent Gazette for Opposition No. 63-21907), a multi-domain vertical aligned (MVA) mode liquid crystal display device (see Japanese Laid-Open Publication No. 11-242225), an axisymmetric aligned (ASM) mode liquid crystal display device (see Japanese Laid-Open Publication No. 10-186330), and a liquid crystal display device disclosed in Japanese Laid-Open Publication No. 2002-55343 were developed recently.

All of these were developed relatively recently as TN mode liquid crystal display devices with improved viewing angle characteristics. In a liquid crystal display device operating in each of these newly developed wide viewing angle modes, even when an image on the screen is viewed obliquely, the contrast ratio never decreases significantly or the grayscales never invert unlike the old-fashioned TN mode liquid crystal display devices.

However, in the IPS or MVA mode liquid crystal display device, the gray-scale voltage applied to the liquid crystal layer needs to be controlled more precisely than in the conventional TN mode liquid crystal display device. This is because in the IPS or MVA mode liquid crystal display device, the ratio $\alpha$ of the variation in luminance Y to the variation in applied voltage V (i.e., $\alpha=\Delta Y/\Delta V$) is greater than in the TN mode LCD.

Another reason is that the TN mode liquid crystal display device usually conducts a display operation in normally white (NW) mode whereas the IPS or MVA mode liquid crystal display device needs to perform a display operation in normally black (NB) mode.

In a normal display device with 256 grayscales (in which the grayscale 0 represents the lowest brightness (i.e., black) and the grayscale 255 represents the highest brightness (i.e., white)) and with its $\gamma$ characteristic controlled at 2.2, unevenness of display (i.e., unevenness in brightness) is observed most remarkably when a color between grayscales 20 and 60 (i.e., a intermediate tone (gray) near black) is displayed. In an NB mode liquid crystal display device, the ratio $\alpha$ of the variation in luminance to the variation in applied voltage at such an intermediate tone near black is greater than that of an NW mode liquid crystal display device. For that reason, to reduce the unevenness of display, the voltage applied to the liquid crystal layer needs to be controlled highly precisely.

Accordingly, in the IPS or MVA mode liquid crystal display device, the patterning accuracy of TFTs and other circuit components and the performance of driver circuits (including various signal voltage generators) must be increased, thus raising the manufacturing cost significantly. Stated otherwise, if the patterning accuracy of TFTs and other circuit components and the performance of driver circuits were almost the same, the IPS or MVA mode liquid crystal display device would exhibit lower uniformity (or display quality) and lower resolution than the conventional TN mode liquid crystal display device when the image on the screen is viewed straightforward.

As described above, the unevenness of display due to the high luminance-applied voltage variation ratio ($\alpha=\Delta Y/\Delta V$) is much more significant in the IPS or MVA mode liquid crystal display device than in the conventional TN mode liquid crystal display device (and more significant in an NB mode liquid crystal display device than in an NW liquid crystal display device). Nevertheless, this problem is commonly observed in every liquid crystal display device, although their degrees are different. And if that ratio of the variation in luminance to the variation in applied voltage (i.e., $\alpha=\Delta Y/\Delta V$) can be reduced, the display quality can be improved in any liquid crystal display device operating in any mode.

SUMMARY OF THE INVENTION

In order to overcome the problems described above, preferred embodiments of the present invention provide a liquid crystal display device that can present an image of quality with the unevenness of display minimized and also provide a liquid crystal display device that can be driven with a reduced applied voltage.

A liquid crystal display device according to a preferred embodiment of the present invention includes a plurality of pixels, each of which includes a liquid crystal capacitor made up of a liquid crystal layer and two electrodes to apply a voltage to the liquid crystal layer.

While the device is conducting a display operation, an oscillation voltage, which oscillates a number of times within a single vertical scanning period, and a predetermined gray-scale voltage are applied to the liquid crystal capacitor of an arbitrary one of the pixels.

A liquid crystal display device according to another preferred embodiment of the present invention includes a plurality of pixels, each of which includes a liquid crystal capacitor made up of a liquid crystal layer and two electrodes to apply a voltage to the liquid crystal layer. In an arbitrary vertical scanning period, a predetermined gray-scale voltage is applied to one of the two electrodes of an arbitrary one of the pixels and an oscillation voltage, which oscillates a number of times within a single vertical scanning period, is applied to either the same electrode or the other electrode of the arbitrary pixel.

A liquid crystal display device according to still another preferred embodiment of the present invention includes: a plurality of pixels, each of which includes a liquid crystal capacitor made up of a liquid crystal layer and two electrodes to apply a voltage to the liquid crystal layer; a gray-scale voltage generator for generating a gray-scale voltage in accordance with a display signal; a counter voltage generator for generating a counter voltage; and an oscillation voltage generator for generating an oscillation voltage that oscillates a number of times within a single vertical scanning period. In an arbitrary vertical scanning period, the gray-scale voltage is applied to one of the two electrodes of an arbitrary one of the pixels, the counter voltage is applied to the other electrode of the arbitrary pixel, and the oscillation voltage is applied to either the one or the other electrode of the arbitrary pixel.

In one preferred embodiment of the present invention, in each of the pixels, the two electrodes of the liquid crystal capacitor are a pixel electrode, which is provided for each said pixel, and a counter electrode, which applies a common counter voltage to all of the pixels. The gray-scale voltage is applied to the pixel electrode and the oscillation voltage is applied to the counter electrode.

In another preferred embodiment, each said pixel further includes a storage capacitor. The liquid crystal capacitor includes a pixel electrode, which is provided for each said pixel, and a counter electrode, which is provided for all of the pixels in common. The storage capacitor includes a first electrode, which is electrically connected to the pixel electrode, an insulating layer, and a second electrode, which faces the first electrode with the insulating layer interposed between the first and second electrodes. The oscillation voltage is applied to the second electrode.

In this particular preferred embodiment, the pixels are arranged in columns and rows. In an arbitrary vertical scanning period, the respective second electrodes of all pixels belonging to an arbitrary one of the rows are electrically connected together.

More specifically, the oscillation voltages applied to the respective second electrodes of the pixels belonging to the arbitrary row are substantially equal to each other.

In a specific preferred embodiment, the oscillation voltage includes a first oscillation voltage and a second oscillation voltage, which is different from the first oscillation voltage. The oscillation voltages applied to the respective second electrodes of the pixels belonging to the arbitrary row during the arbitrary vertical scanning period are either the first oscillation voltage or the second oscillation voltage.

In that case, in an arbitrary vertical scanning period, the first oscillation voltage is applied to the respective second electrodes of all pixels belonging to one of two mutually adjacent rows, and the second oscillation voltage is applied to the respective second electrodes of all pixels belonging to the other row.

More specifically, the first and second oscillation voltages both have a period corresponding to two horizontal scanning periods, and have the same amplitude but a phase difference of 180 degrees.

In another preferred embodiment, in the arbitrary vertical scanning period, the oscillation voltage applied to the respective second electrodes of the pixels changes every m consecutive rows.

In that case, each of the periods of the oscillation voltage, which also changes every m consecutive rows, is m times as long as one horizontal scanning period and has the same amplitude.

In still another preferred embodiment, the oscillation voltages applied to the respective second electrodes of the pixels during the arbitrary vertical scanning period are substantially equal to each other.

In this particular preferred embodiment, the oscillation voltages have a period corresponding to one horizontal scanning period.

In yet another preferred embodiment, the liquid crystal display device further includes a TFT, which is provided for each said pixel, and a gate bus line and a source bus line, which are connected to each TFT. The respective second electrodes of the pixels belonging to the arbitrary row are connected to the gate bus line associated with the row.

In yet another preferred embodiment, the pixels are arranged in columns and rows. The liquid crystal display device further includes a TFT, which is provided for each said pixel, a gate bus line and a source bus line, which are connected to each TFT, and a plurality of CS bus lines. Each of the CS bus lines connects together the respective second electrodes of pixels belonging to an associated one of the rows. In the CS bus lines, there are an even number of electrically independent CS bus lines.

In yet another preferred embodiment, the voltage waveform of the oscillation voltage includes at least three potentials including two potentials that define maximum amplitude and another potential equal to an average potential.

In yet another preferred embodiment, supposing the storage capacitor has a capacitance CCS, the liquid crystal capacitor has a minimum capacitance CLC_min and an electro-optic characteristic of the liquid crystal layer has a threshold voltage Vth, the effective value of the oscillation voltage is at least one-tenth of, and at most equal to, $Vth\cdot\{(CCS+CLC_min)/CCS\}$.

In yet another preferred embodiment, the effective value of the oscillation voltage is at least one-tenth of, and at most equal to, the electro-optic threshold voltage Vth of the liquid crystal layer.

In yet another preferred embodiment, the oscillation voltage oscillates in a period that is an integral number of times as long as one horizontal scanning period.

In yet another preferred embodiment, the oscillation voltage oscillates in a period corresponding to one horizontal scanning period.

In yet another preferred embodiment, the liquid crystal display device conducts a display operation in normally black mode.

An LCD driving method according to a preferred embodiment of the present invention is a method for driving a liquid crystal display device including a plurality of pixels, each of which includes a liquid crystal capacitor made up of a liquid crystal layer and two electrodes to create a potential difference in the liquid crystal layer. The method includes the steps of: applying an oscillation voltage, which oscillates in a period that is shorter than one vertical scanning period, to the liquid crystal capacitors of all of the pixels in an arbitrary vertical scanning period; and applying gray-scale voltages, which are associated with the respective pixels, to the respective liquid crystal capacitors thereof while the oscillation voltage is being applied.

According to any of various preferred embodiments of the present invention described above, an oscillation voltage is applied, as a superposed voltage on a gray-scale voltage, to each liquid crystal capacitor. Thus, the ratio of the variation in luminance to the variation in gray-scale voltage (i.e., the gradient of a V-Y curve) can be reduced. As a result, the unevenness of display can be minimized and an image of quality can be displayed. The ratio of the variation in luminance to the variation in gray-scale voltage can be reduced particularly effectively in a range where the gray-scale voltage is relatively low. For that reason, the display quality of an NB mode liquid crystal display device, among other things, can be improved significantly. In addition, by superposing the oscillation voltage, the threshold voltage of the electro-optic characteristic can be reduced, thus providing a liquid crystal display device that can be driven with a lower applied voltage.

Other features, elements, processes, steps, characteristics and advantages of the present invention will become more apparent from the following detailed description of preferred embodiments of the present invention with reference to the attached drawings.

BRIEF DESCRIPTION OF THE DRAWINGS

FIG. 5A shows the V-Y characteristics of an LCD operating in an NB mode; and FIG. 5B shows the V-Y characteristics of an LCD operating in an NW mode such as the TN mode.

FIG. 6A is a graph showing V-Y characteristics;

FIG. 6B is a graph showing how the luminance Y changes with the gray-scale N; and FIG. 6C is a graph showing how the gray-scale voltage (½)×V_sigpp changes with the gray-scale N.

DETAILED DESCRIPTION OF PREFERRED EMBODIMENTS

Hereinafter, a liquid crystal display device and its driving method according to preferred embodiments of the present invention will be described with reference to the accompanying drawings.

First, a conventional typical LCD driving method will be described with reference to FIGS. 1A and 1B.

Figure 1B:
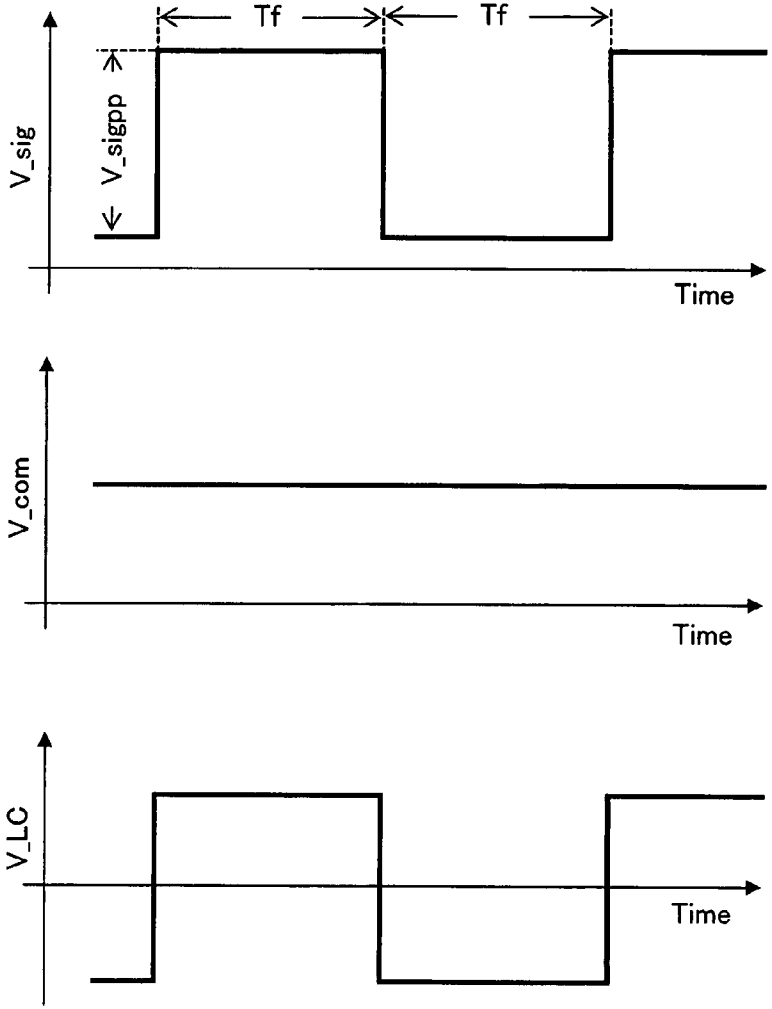
FIG. 1A schematically shows the configuration of a conventional typical LCD 10 and FIG. 1B shows an exemplary driving method thereof.
Figure 1A:
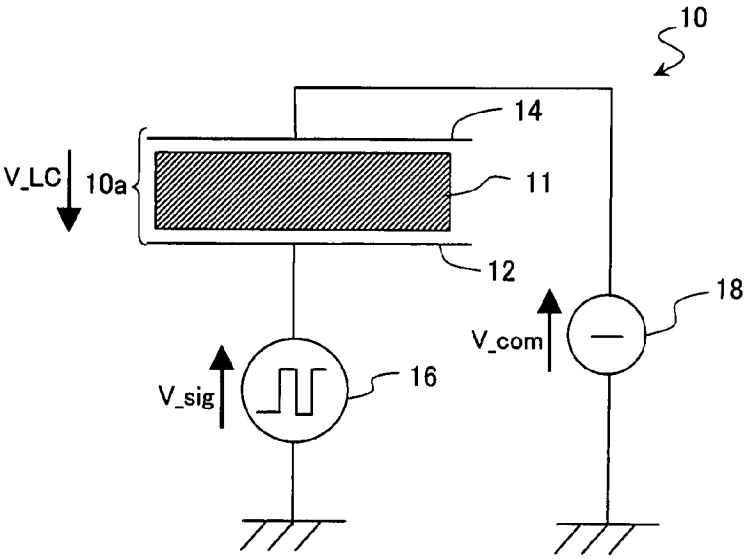

FIG. 1A schematically illustrates the configuration of one pixel in a conventional typical LCD 10. This pixel includes a liquid crystal capacitor 10*a* consisting of a liquid crystal layer 11 and two electrodes (namely, a pixel electrode 12 and a counter electrode 14) for applying a potential to the liquid crystal layer 11. A predetermined gray-scale voltage V_sig is applied from a gray-scale voltage generator 16 to the pixel electrode 12, while a counter voltage is applied from a counter voltage generator 18 to the counter electrode 14.

In an active-matrix-addressed LCD, each pixel usually has a storage capacitor to hold the voltage at the liquid crystal capacitor 10*a* and an active component such as a TFT, the illustration of which is omitted from FIG. 1A for the sake of simplicity. Also, in FIG. 1A, the pixel electrode 12 and counter electrode 14 are illustrated as defining a parallel plate structure and facing each other with the liquid crystal layer 11 interposed between them. However, as in the IPS mode LCD mentioned above, the pixel electrode 12 and counter electrode 14 may define a comb electrode structure on the same substrate.

FIG. 1B schematically shows the respective waveforms of the gray-scale voltage V_sig applied to the pixel electrode 12, the counter voltage V_com applied to the counter electrode 14, and a voltage V_LC applied to the liquid crystal capacitor 10*a*.

The gray-scale voltage V_sig is a rectangular wave, which has an amplitude V_sigpp representing the display luminance (or gray scale) and which oscillates in a period that is twice as long as one vertical scanning period (that is equal herein to one frame period Tf). On the other hand, the counter voltage V_com is a direct current voltage, which is constant irrespective of the display luminance and with respect to the time axis. The counter voltage V_com is defined such that the average value V_LCave of the voltage V_LC applied to the liquid crystal capacitor 10*a* becomes equal to 0 V. Accordingly, the effective value V_LCrms of the voltage V_LC (=V_sig−V_com) applied to the liquid crystal capacitor 10*a* (or the liquid crystal layer 11) becomes a rectangular wave, of which the effective value is a half of the amplitude V_sigpp of the gray-scale voltage V_sig and of which the period is twice as long as Tf. Consequently, in the conventional typical LCD, the effective value V_LCrms of the voltage V_LC applied to the liquid crystal capacitor 10*a* is always a half of V_sigpp irrespective of the gray scale to display (i.e., at any gray scale from black through white).

The voltage V_LC applied to the liquid crystal capacitor 10*a* needs to be a rectangular wave oscillating in a period that is twice as long as Tf and inverting its polarity every frame period Tf to improve the reliability of the LCD. Thus, it is common to set the polarity inversion interval (i.e., a half of the inversion period) equal to one vertical scanning period (which may be equal to one frame period of approximately 16.7 ms).

As used herein, "one vertical scanning period" is defined as a period of time that passes after a scan line was selected and until the next scan line is selected. Thus, one vertical scanning period is equal to one frame period in a non-interlaced driving method and to one field period in an interlaced driving method, respectively. Also, within each vertical scanning period, the interval between a time at which one scan line is selected and a time at which the next scan line is selected will be referred to herein as "one horizontal scanning period (1H)".

Next, the configuration of an LCD 20 according to a preferred embodiment of the present invention and its driving method will be described with reference to FIGS. 2A and 2B.

Figure 2B:
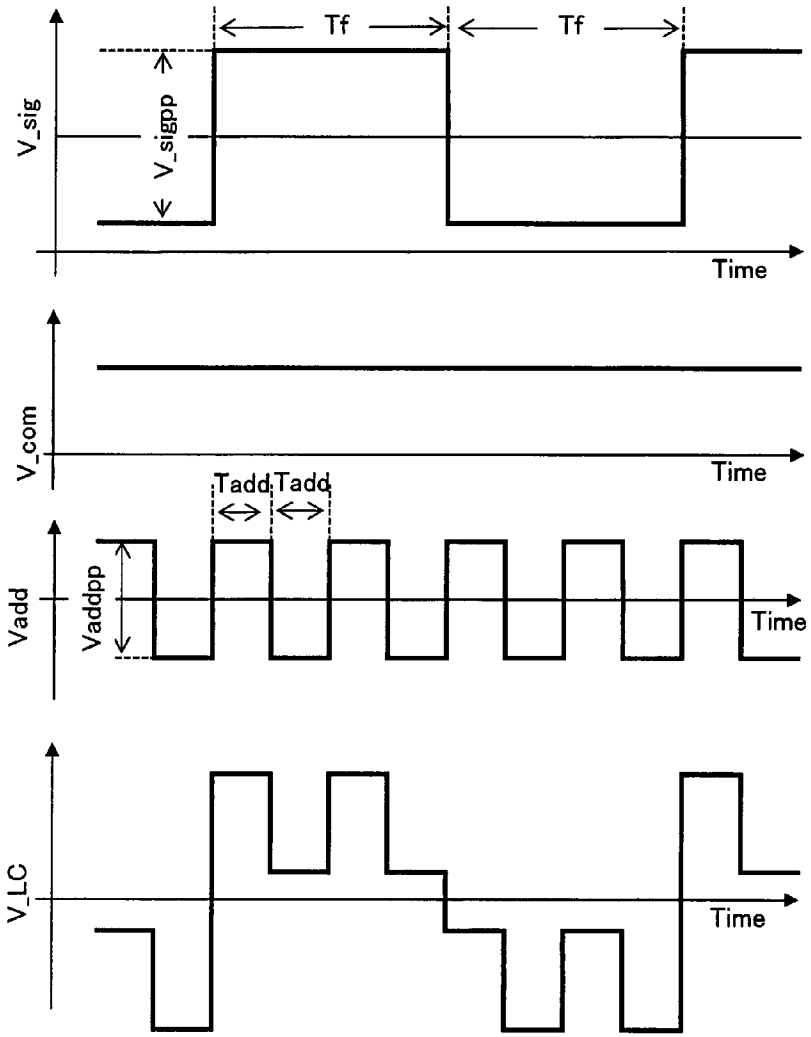
FIG. 2A schematically shows the configuration of an LCD 20 according to a preferred embodiment of the present invention and FIG. 2B shows an exemplary driving method thereof.
Figure 2A:
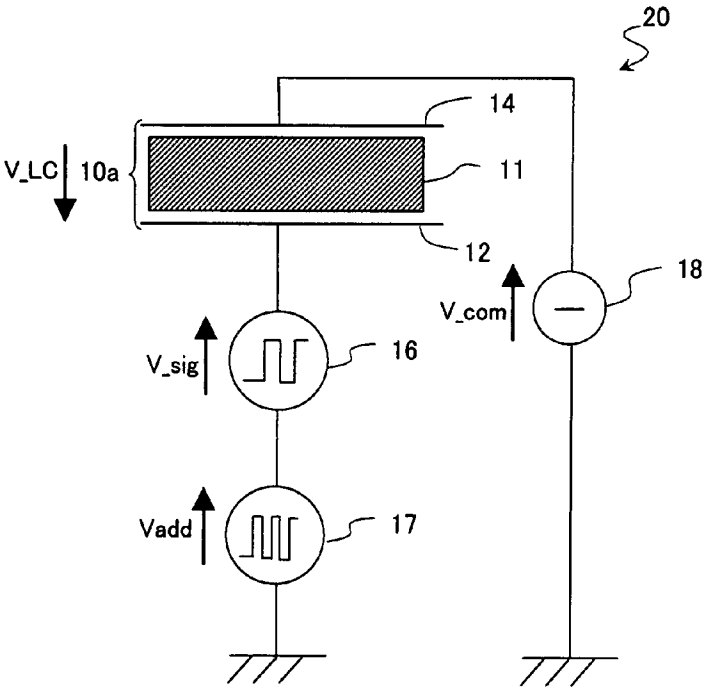

FIG. 2A schematically illustrates the configuration of one pixel in the LCD 20. In FIG. 2A, each component having substantially the same function as the counterpart shown in FIG. 1A is identified by an identical reference numeral and the description thereof will be omitted herein. In addition to every component of the LCD 10 shown in FIG. 1A, the LCD 20 further includes an oscillation voltage generator 17.

In the LCD 20, an oscillation voltage Vadd generated by the oscillation voltage generator 17 is applied to the pixel electrode 12. Accordingly, not only the predetermined gray-scale voltage V_sig but also the oscillation voltage Vadd are applied to the pixel electrode 12 from the gray-scale voltage generator 16 and oscillation voltage generator 17, respectively. In FIG. 2A, the output of the oscillation voltage generator 17 is directly supplied to the pixel electrode 12. However, as will be described later, if a storage capacitor is connected to the pixel electrode 12, then the oscillation voltage may be applied to the pixel electrode 12 indirectly by way of the storage capacitor by applying the oscillation voltage to the electrodes that make up the storage capacitor.

As shown in FIG. 2B, the gray-scale voltage generator 16 and counter voltage generator 18 output the same gray-scale voltage V_sig and the same counter voltage V_com as those shown in FIG. 1B.

The oscillation voltage Vadd generated by the oscillation voltage generator 17 is a rectangular wave, which has a constant amplitude Vaddpp that never changes irrespective of the display luminance (or gray-scale), has an average oscillation voltage Vaddave of 0 volts, and oscillates in a period that is twice as long as Tadd (where Tadd<Tf). To increase the uniformity of display, Tadd is preferably obtained by dividing Tf by an integer. That is to say, Tadd=Tf/2, Tf/3, Tf/4, . . . , and Tf/k (where k is a natural number) is preferably satisfied. More preferably, k>100 is satisfied.

The gray-scale voltage V_sig and oscillation voltage Vadd are applied to the pixel electrode 12 and the counter voltage V_com is applied to the counter electrode 14. As a result, the voltage applied to the liquid crystal capacitor 10*a* is obtained by superposing the oscillation voltage Vadd having an amplitude Vaddpp and an oscillation period that is twice as long as Tadd on the rectangular wave having an oscillation period that is twice as long as Tf and an effective value that is a half of V_sigpp (i.e., the same voltage as that of the typical LCD shown in FIG. 1).

Accordingly, in the LCD 20 of this preferred embodiment, even if V_sigpp is zero, the effective value of the voltage V_LC applied to the liquid crystal capacitor 10*a* does not become zero but a half of the amplitude Vaddpp of the oscillation voltage (i.e., Vaddrms).

Also, the greater the difference between the gray-scale voltage (½)×V_sigpp generated by the gray-scale voltage generator 16 and the effective value Vaddrms of the oscillation voltage, the closer to the gray-scale voltage (½)×V_sigpp the effective value of the voltage V_LCrms applied to the liquid crystal capacitor 10*a*. That is to say, in a range where the gray-scale voltage (½)×V_sigpp has a small value, the effective voltage V_LCrms applied to the liquid crystal capacitor 10*a* does not change so much even when the gray-scale voltage changes. This is the prime feature of the present invention, which is essentially different from the conventional typical LCD.

Figure 3B:
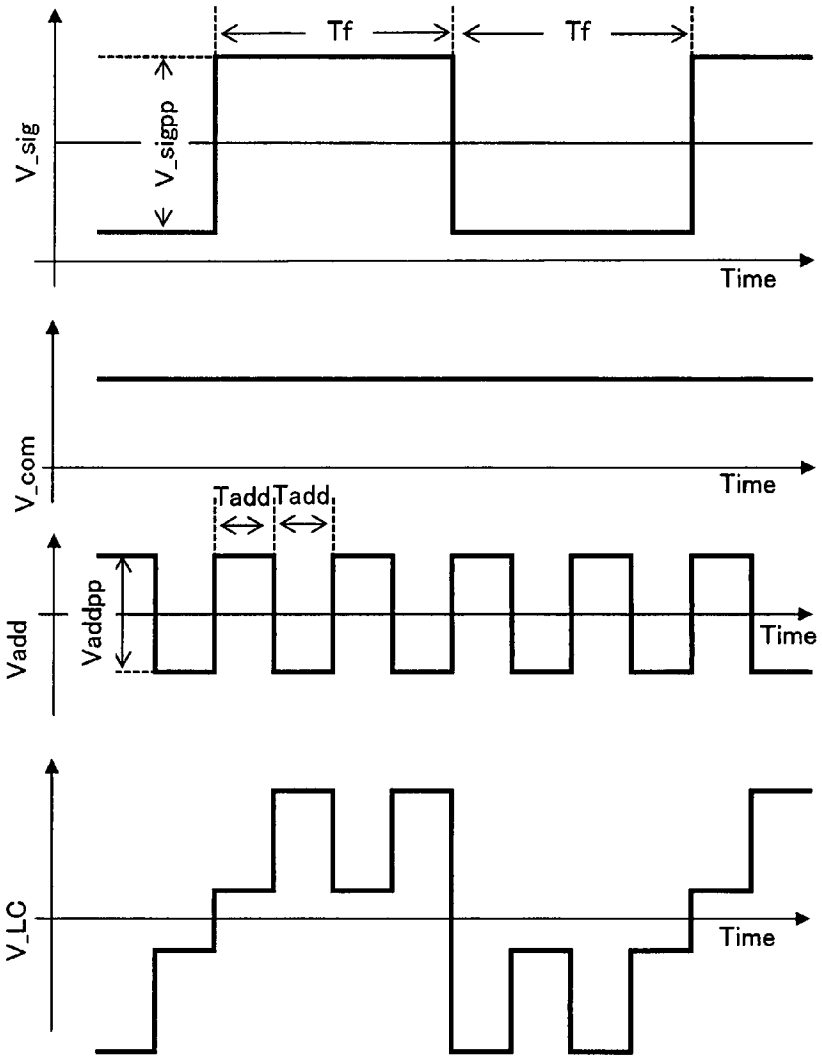
FIG. 3A schematically shows the configuration of an LCD 30 according to another preferred embodiment of the present invention and FIG. 3B shows an exemplary driving method thereof.
Figure 3A:
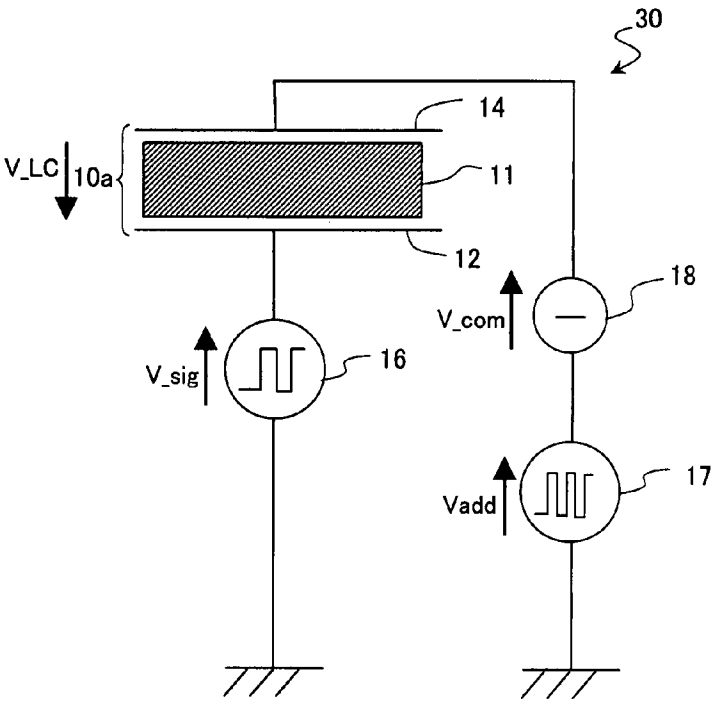

Next, the configuration and operation of an LCD 30 according to another preferred embodiment of the present invention will be described with reference to FIGS. 3A and 3B.

The LCD 30 has a configuration in which the output of the oscillation voltage generator 17 is supplied to the counter electrode 14. As shown in FIG. 3B, the voltages generated by the gray-scale voltage generator 16, oscillation voltage generator 17 and counter voltage generator 18 are the same as the counterparts shown in FIG. 2B.

The oscillation voltage Vadd is applied to the pixel electrode 12 in the LCD 20 but to the counter electrode 14 in the LCD 30, respectively. However, both of the pixel electrode 12 and counter electrode 14 are electrodes that make up the liquid crystal capacitor 10*a*. Accordingly, the voltage V_LC applied to the liquid crystal capacitor 10*a* as shown in FIG. 3B has essentially the same waveform as that shown in FIG. 2B. As a result, the same essential function of the present invention is achieved by this LCD 30 as well as by the LCD 20 shown in FIG. 2B.

Next, it will be described with reference to FIGS. 4 and 5 exactly what effects are achieved by additionally applying (i.e., as a superposition) the oscillation voltage Vadd to the liquid crystal capacitor 10*a*.

Figure 4:
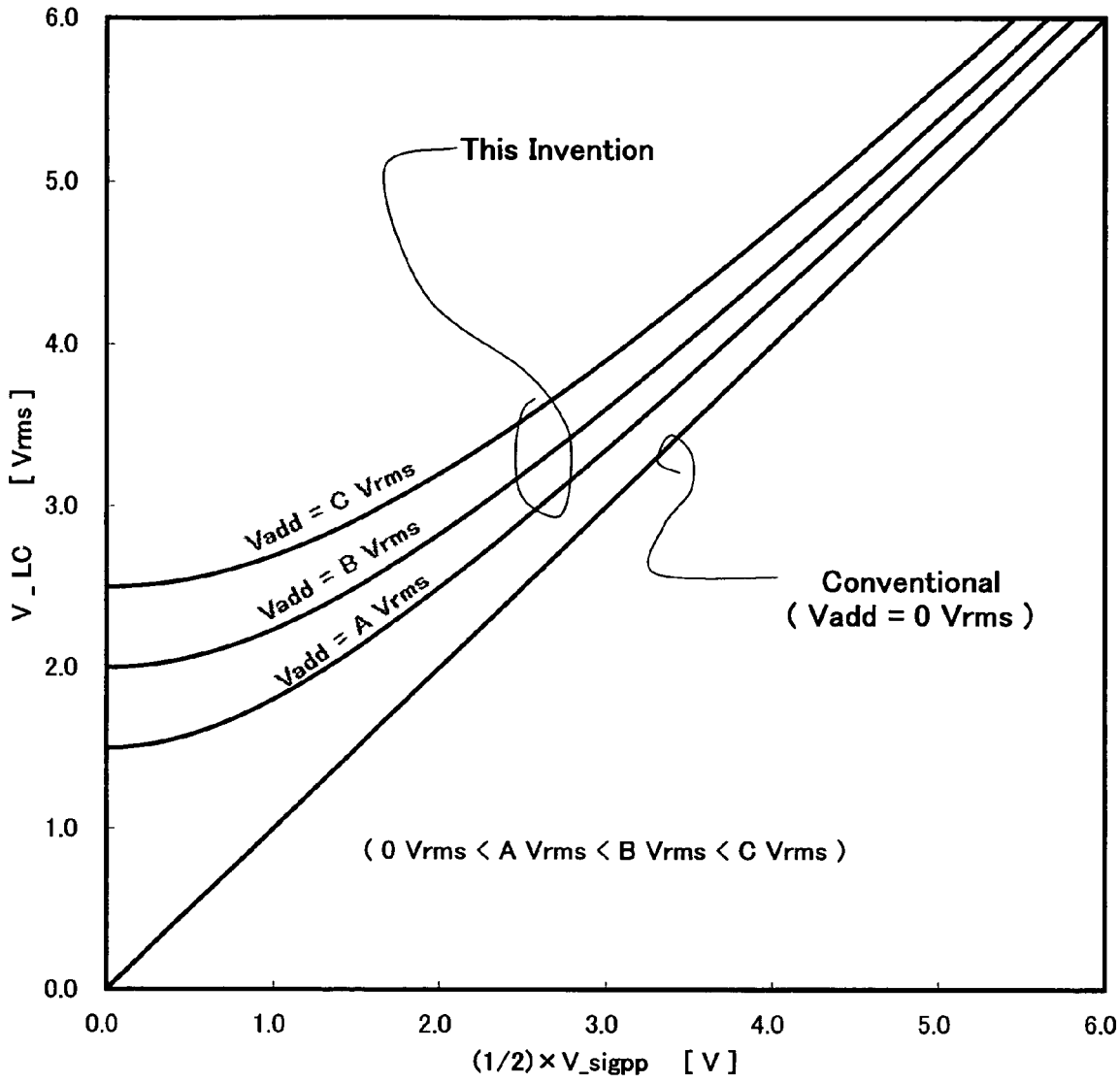
FIG. 4 is a graph showing how the voltage applied to the liquid crystal layer changes with the gray-scale voltage in an LCD according to a preferred embodiment of the present invention.

FIG. 4 is a graph showing the gray-scale voltage dependence of the voltage V_LCrms applied to the liquid crystal capacitor 10*a* using the Vaddrms value as a parameter. In FIG. 4, the abscissa represents the gray-scale voltage (½)×V_sigpp. The Vaddrms value was supposed to be one of the four values of 0 Vrms, A Vrms, B Vrms and C Vrms (where 0 Vrms<A Vrms<B Vrms<C Vrms). The effective Vrms values of A, B and C were supposed to be 1.5 Vrms, 2.0 Vrms, and 2.5 Vrms, respectively. As described above, when the gray-scale voltage (½)×V_sigpp is 0 V, the V_LCrms value is equal to the Vaddrms value. Also, the greater the gray-scale voltage value, the closer to the gray-scale voltage value the V_LCrms value becomes.

As can be seen from FIG. 4, as the Vaddrms value increases, the ratio of the variation in V_LCrms to the variation in gray-scale voltage (½)×V_sigpp (i.e., the gradient of the curve, or ΔV_LCrms/Δ(½)×V_sigpp) decreases in a range with a low gray-scale voltage (i.e., where the voltage (½)×V_sigpp is low). Compared with the line representing Vaddrms=0 Vrms in FIG. 4 (which corresponds to the conventional LCD), it can be seen that ΔV_LCrms/Δ(½)×V_sigpp can be reduced by applying the oscillation voltage Vaddrms. It can also be seen that this effect is significant when the gray-scale voltage (½)×V_sigpp is relatively low.

Figure 5B:
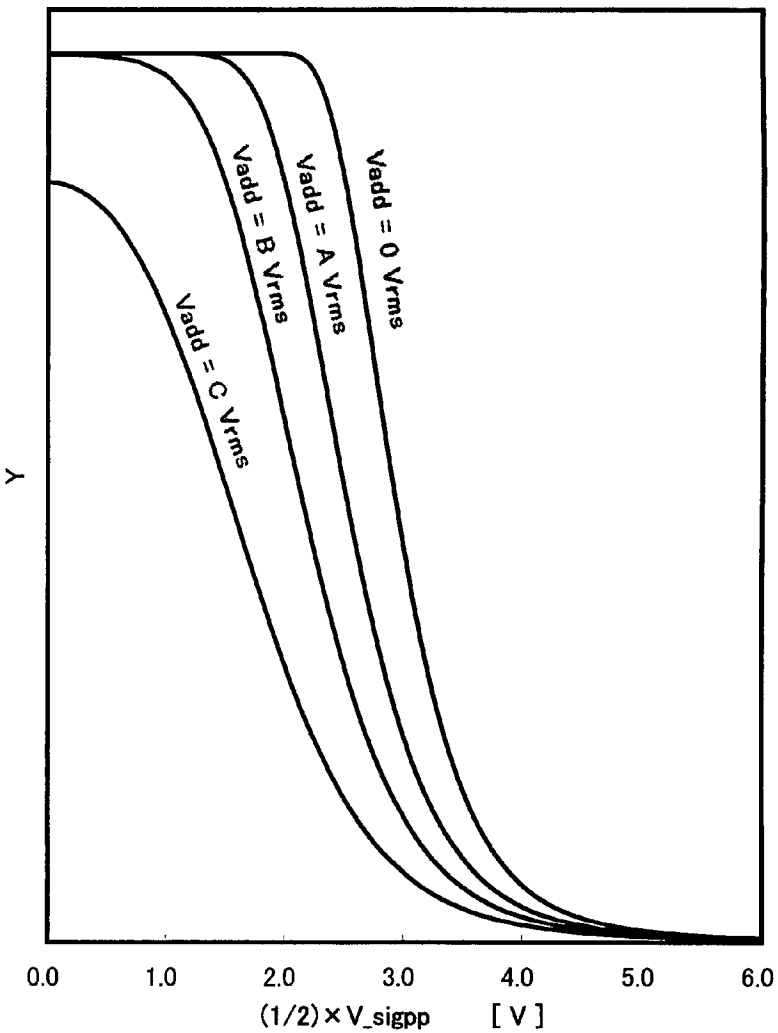
FIGS. 5A and 5B are graphs each showing the gray-scale voltage dependence of the luminance Y of an LCD (i.e., the V-Y characteristic) using the Vaddrms value as a parameter.
Figure 5A:
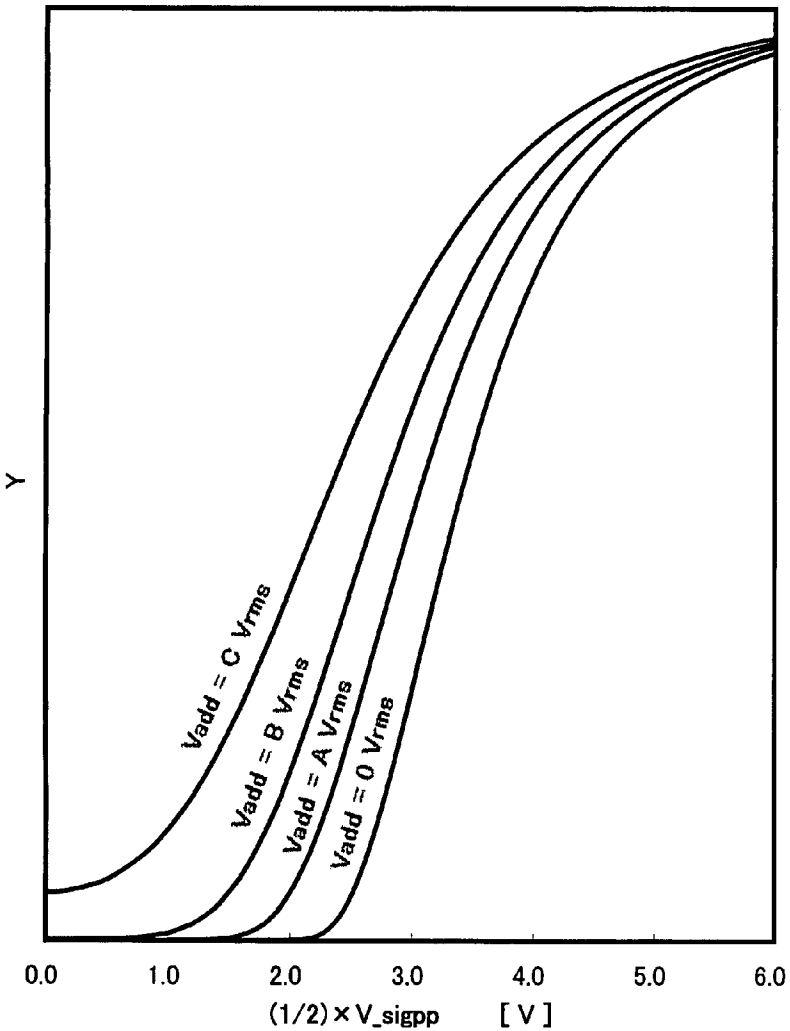

FIGS. 5A and 5B are graphs each showing the gray-scale voltage dependence of the luminance Y of an LCD (i.e., the V-Y characteristic) using the Vaddrms value as a parameter. In FIGS. 5A and 5B, the abscissa represents the gray-scale voltage (½)×V_sigpp. Specifically, FIG. 5A shows the V-Y characteristic of an LCD operating in an NB mode such as the MVA mode or IPS mode, while FIG. 5B shows the V-Y characteristic of an LCD operating in an NW mode such as the TN mode. This V-Y characteristic will be sometimes referred to herein as the "electro-optic characteristic of the liquid crystal layer".

As can be seen from FIGS. 5A and 5B, as the Vaddrms value increases, the ratio of the variation in luminance Y to the variation in gray-scale voltage (½)×V_sigpp (i.e., the gradient of the curve, or ΔY/Δ(½)×V_sigpp) decreases in a range with a low gray-scale voltage (i.e., where the voltage (½)×V_sigpp is low).

First, referring to FIG. 5A, it can be seen that the greater the Vaddrms value, the smaller the threshold voltage Vth in the V-Y characteristic (i.e., the voltage at which the luminance starts to rise: approximately 2.2 V when Vadd=0 Vrms). Once the Vaddrms value exceeds the threshold voltage (of approximately 2.2 V) when Vadd=0 Vrms, the threshold voltage disappears (see the curve representing Vadd=C Vrms). Accordingly, once Vaddrms exceeds the threshold voltage Vth of the V-Y characteristic when Vadd=0 Vrms, a sufficiently low luminance (i.e., a black display state) cannot be achieved and the display contrast ratio decreases significantly even by setting the gray-scale voltage (½)×V_sigpp equal to 0 V. However, it is naturally possible to maintain a sufficient display contrast ratio and a rather low threshold voltage by setting the Vaddrms value appropriately. The effective Vadd value is preferably at least one-tenth as large as, and at most equal to, the threshold voltage Vth of the V-Y characteristic. This reason is that if the effective Vadd value were less than one-tenth of Vth, good effects would not be achieved even by adding Vadd but if the Vadd value exceeded Vth, the contrast ratio should decrease.

FIG. 5B shows the V-Y characteristics obtained by applying the present invention to the TN mode. It can be seen from FIG. 5B that as the effective Vadd value increases, the V-Y characteristic shifts toward lower voltages. That is to say, it can be seen that a liquid crystal display device to be driven with a lower voltage can be obtained according to the present invention.

Figure 6A:
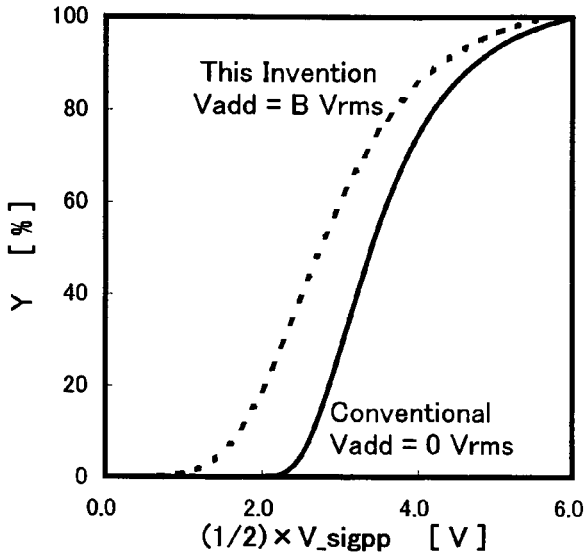
FIGS. 6A, 6B and 6C show how the display unevenness can be reduced by decreasing the ratio of the variation in luminance Y to the variation in gray-scale voltage (½)×V_sigpp (i.e., ΔY/Δ(½)×V_sigpp)

Next, it will be described with reference to FIGS. 6A, 6B, 6C and 7 how the display unevenness can be reduced by decreasing the ratio of the variation in luminance Y to the variation in gray-scale voltage (½)×V_sigpp (i.e., ΔY/Δ(½)×V_sigpp) in a range where the gray-scale voltages are relatively low. As described above, the display unevenness can be reduced particularly significantly in an NB mode LCD. Thus, the following description will relate to an NB mode LCD. FIG. 6A is a graph showing V-Y characteristics in a situation where Vadd=B Vrms (in an LCD according to a preferred embodiment of the present invention) and a situation where Vadd=0 Vrms (in a conventional LCD).

The reduction of the display unevenness was evaluated by using the ratio of the variation ΔY in luminance to a predetermined variation ΔV in gray-scale voltage (½)×V_sigpp as an index. The variation ΔY in luminance was calculated with respect to a luminance Y associated with an arbitrary gray scale N. The gray scale (N) dependence of the display luminance (Y) of a typical LCD is defined as shown in FIG. 6B.

Figure 6B:
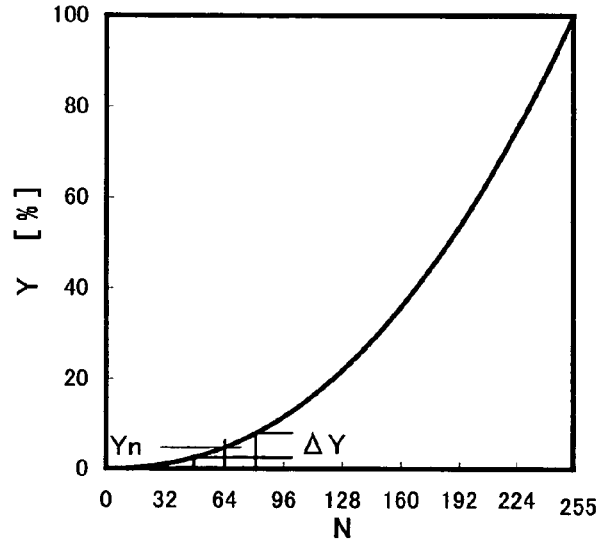
Figure 6C:
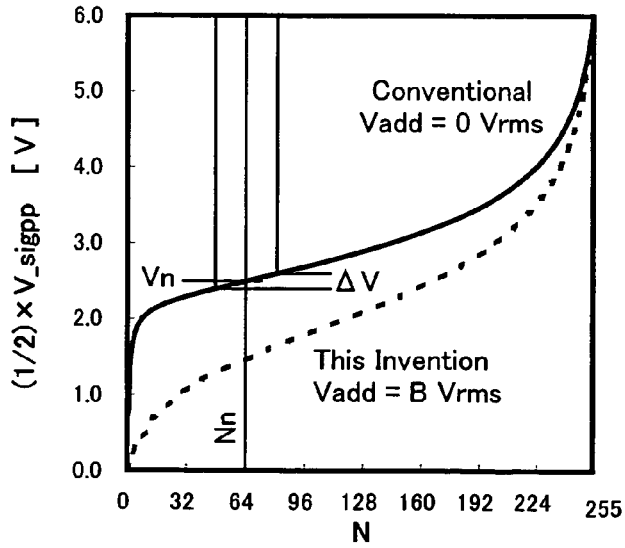

If the given LCD has one of the V-Y characteristics shown in FIG. 6A, then the gray-scale voltage needs to be set with respect to the gray scale N as shown in FIG. 6C to achieve the gray-scale dependence of the display luminance as shown in FIG. 6B.

Suppose the gray-scale voltage being applied to the liquid crystal capacitor changes from a predetermined gray-scale voltage Vn by ΔV while an arbitrary gray scale Nn is being displayed. In that case, the display luminance changes by ΔY. This variation ΔV is produced in the gray-scale voltage being applied to the liquid crystal capacitor due to the precision of the gray-scale voltage generator or some variation in the characteristic of TFTs included in the LCD (i.e., due to a variation accompanying a normal manufacturing process).

Also, even if the variation ΔV resulting from a manufacturing process is the same, the unevenness of luminance as observed in an LCD also changes with the V-Y characteristic of the LCD. More specifically, the steeper the display gray-scale dependence of the gray-scale voltage (½)×V_sigpp shown in FIG. 6C (i.e., the gentler the gray-scale voltage ((½)×V_sigpp) dependence of the luminance (Y)), the smaller the ΔY value and the less noticeable the display unevenness. As shown in FIG. 6A, the LCD of this preferred embodiment can diminish the gray-scale voltage dependence of the display luminance, and therefore, can also directly reduce the display unevenness as a result.

Figure 7:
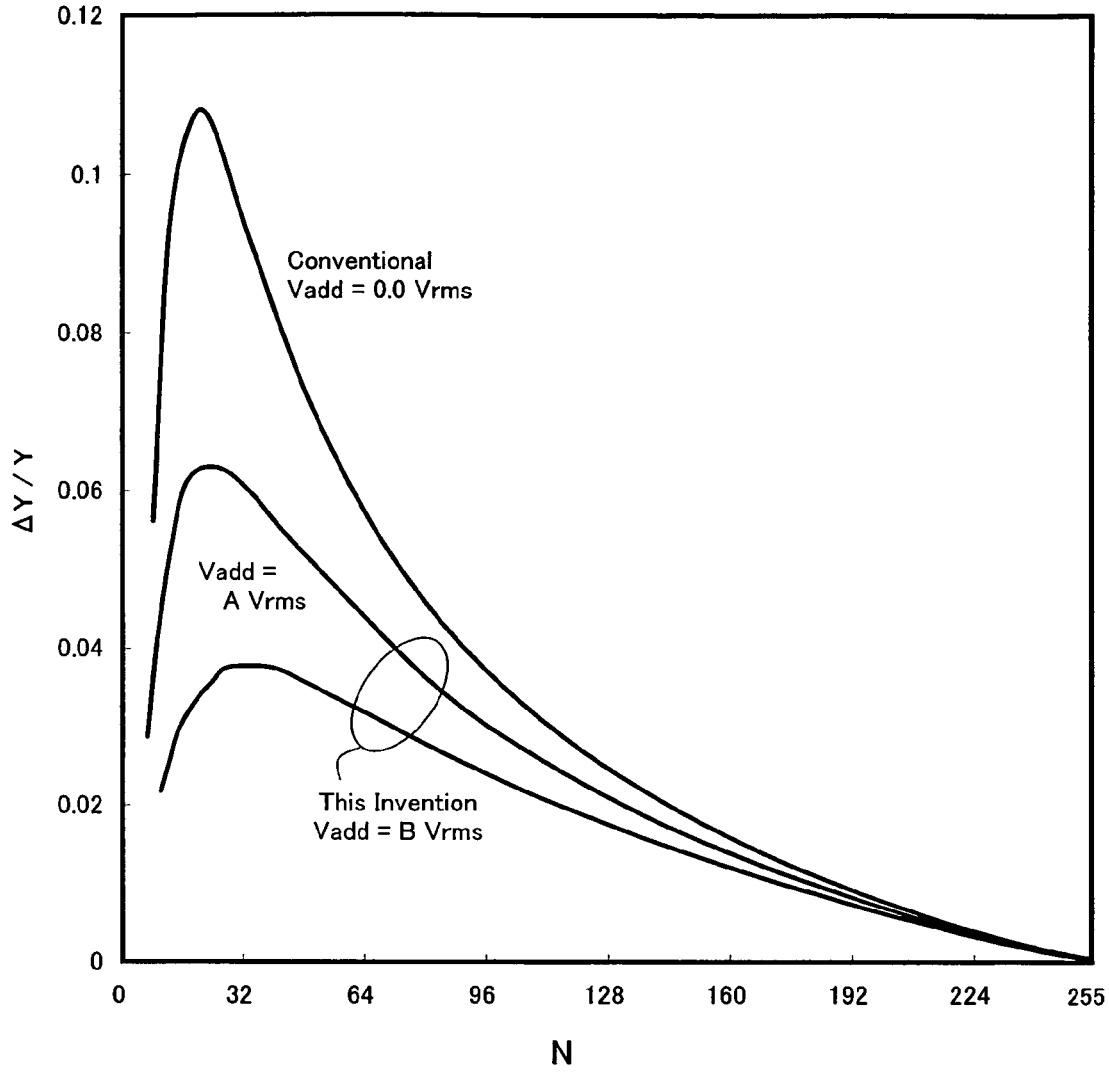
FIG. 7 is a graph showing how the ratio of the variation ΔY in luminance Y (with respect to the variation in gray-scale voltage) to the display luminance Y (i.e., ΔY/Y ratio) decreases in an LCD according to a preferred embodiment of the present invention.

FIG. 7 shows, using the magnitude of Vaddrms as a parameter, how ΔY/Y, which is an index to display unevenness, depends on the gray-scale N in the LCD of this preferred embodiment. The results shown in FIG. 7 were obtained when 256 display gray scales N from No. 0 through No. 255 were used and the gray-scale voltage had a variation ΔV of 10 mV. As can be seen from FIG. 7, when Vadd=0 Vrms as in the conventional typical LCD, the ΔY/Y reached its maximum around gray scale No. 32. This result agrees with the result of subjective evaluation obtained by actually viewing a typical LCD with the eyes. Thus, it can be confirmed that the ΔY/Y value can be used effectively as an index to display unevenness.

As can be seen from FIG. 7, as the Vadd value increases, the ΔY/Y value decreases, and therefore, the display unevenness decreases, too. More specifically, when Vadd=B Vrms=2.0 Vrms, the maximum ΔY/Y value is about one-third of that of the conventional LCD (Vadd=0 Vrms).

As described above, while an LCD according to a preferred embodiment of the present invention is conducting a display operation, an oscillation voltage Vadd and a gray-scale voltage (½)×V_sigpp are applied to the liquid crystal capacitor, thus improving the gray-scale voltage dependence of the display luminance. It should be noted that the oscillation voltage may be a signal that oscillates a number of times within one vertical scanning period. The oscillation voltage to be applied to the liquid crystal capacitor may be applied to one of the two electrodes (i.e., pixel electrode and counter electrode) that make up the liquid crystal capacitor. Thus, the voltage may be applied to either the pixel electrode or the counter electrode. Also, in applying the oscillation voltage to the pixel electrode, there is no need to directly supply the output of the oscillation voltage generator to the pixel electrode. For example, in an active-matrix-addressed LCD in which each pixel includes a switching element such as a TFT and in which a storage capacitor is electrically connected to a liquid crystal capacitor, the oscillation voltage may be applied to one of the two electrodes that make up the storage capacitor.

Hereinafter, the configuration and operation of an active-matrix-addressed LCD according to a preferred embodiment of the present invention will be described.

First, an electrical equivalent circuit of a typical active-matrix-addressed LCD 40 according to a preferred embodiment of the present invention will be described with reference to FIG. 8.

Figure 8:
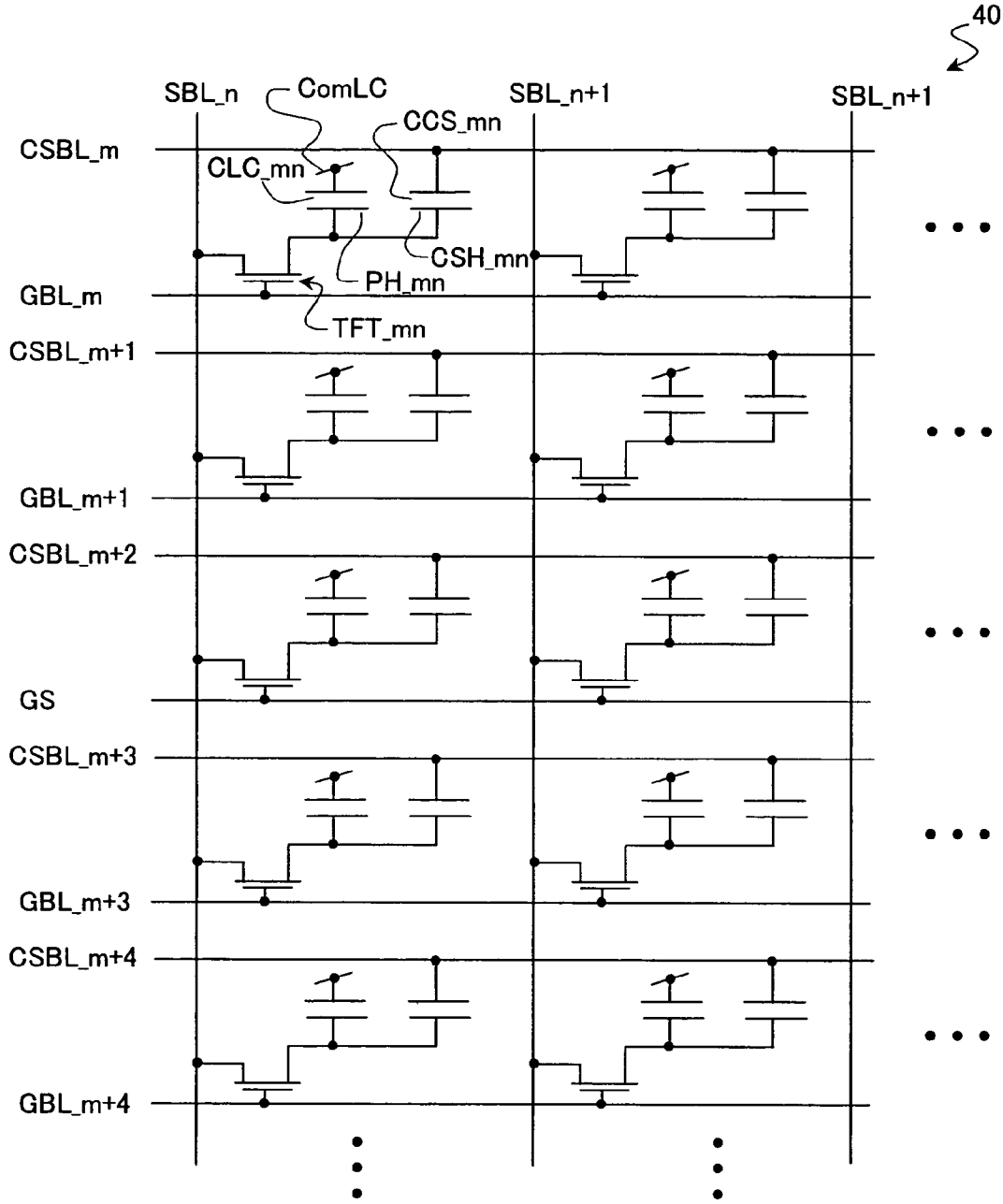
FIG. 8 schematically shows an electrical equivalent circuit of an active-matrix-addressed LCD 40 according to a preferred embodiment of the present invention.

As shown in FIG. 8, the active-matrix-addressed LCD 40 includes a plurality of pixels, each of which includes a TFT (e.g., TFT_mn), a liquid crystal capacitor (e.g., CLC_mn) and a storage capacitor (e.g., CCS_mn). Each and every pixel can be represented by substantially the same electrical equivalent circuit.

The pixel including the TFT TFT_mn will be described. The gate terminal of TFT_mn is connected to a gate bus line (scan line) GBL_m, the source terminal thereof is connected to a source bus line (data line) SBL_n and the drain terminal thereof is connected to one of the two electrodes making up the liquid crystal capacitor CLC_mn (i.e., the pixel electrode PH_mn in this case) and to one of the two electrodes making up the storage capacitor CCS_mn (i.e., the storage capacitor electrode CSH_mn in this case). The other electrode of the liquid crystal capacitor CLC_mn is connected to a liquid crystal capacitor counter electrode ComLC. The other electrode of the storage capacitor CCS_mn (i.e., storage capacitor counter electrode) is connected to a CS bus line CSBL_m. The counter electrode ComLC is typically provided in common for all pixels so that substantially the same voltage can be applied to the liquid crystal capacitor counter electrode of every liquid crystal capacitor CLC_mn. Also, the CS bus line CSBL_m is used as a common electrode at least in the row direction so that substantially the same voltage can be applied to the storage capacitor counter electrode of every storage capacitor CCS_mn belonging to a pixel on each row.

Hereinafter, a method for driving the active-matrix-addressed LCD 40 of this preferred embodiment with the oscillation voltage Vadd applied to each pixel thereof will be described.

In the LCD 40, by applying the oscillation voltage to at least one of the CS bus line CSBL_m and the liquid crystal capacitor counter electrode ComLC, the oscillation voltage Vadd with the oscillation amplitude Vaddpp can be applied to each pixel of the LCD 40 and the effects described above can be achieved. First, a situation where the oscillation voltage is applied to the CS bus line CSBL_m connected to the storage capacitor counter electrode of the storage capacitor CCS_mn will be described.

In the following description, the driving method will be described on only the liquid crystal capacitor CLC_mn for just one vertical scanning period for the sake of simplicity. That is to say, it will be described how to superpose the oscillation voltage Vadd on the voltage VCLC_mn applied to the liquid crystal capacitor CLC_mn during the single vertical scanning period. By reference to the following description, it would be easy to find how to superpose the oscillation voltage on the voltage to be applied to the liquid crystal capacitor in a plurality of pixels, multiple vertical scanning periods, or any of various inversion drive methods for use in a typical LCD.

Figure 9:
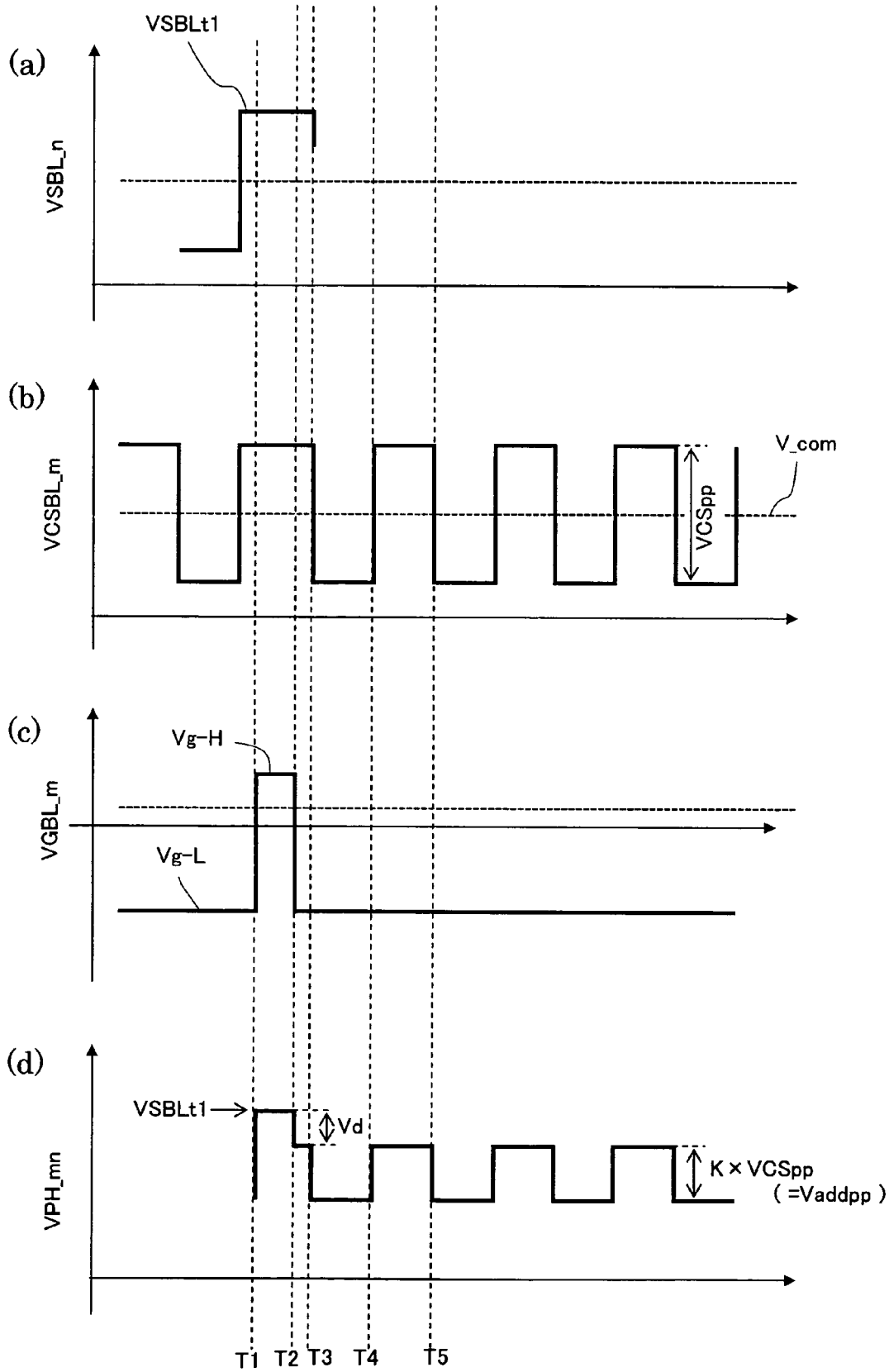
FIG. 9 schematically shows the waveforms of various signals to explain a method for driving the active-matrix-addressed LCD according to the preferred embodiment of the present invention.

FIG. 9 schematically shows the respective waveforms of voltages to be applied to the source bus line SBL_n, gate bus line GBL_m, CS bus line CSBL_m and pixel electrode PH_mn in the LCD 40. Specifically, portion (a) of FIG. 9 shows the waveform VSBL_n of the voltage to be applied to the source bus line SBL_n; portion (b) of FIG. 9 shows the waveform VCSBL_m of the voltage to be applied to the CS bus line CSBL_m; portion (c) of FIG. 9 shows the waveform VGBL_m of the voltage to be applied to the gate bus line GBL_m; and portion (d) of FIG. 9 shows the waveform VPH_mn of the voltage to be applied to the pixel electrode PH_mn. In each of these portions (a) through (d) of FIG. 9, the horizontal dashed line represents the waveform of the voltage VComLC to be applied to the liquid crystal capacitor counter electrode ComLC.

In this preferred embodiment, to superpose the oscillation voltage Vadd on the voltage VCLC applied to the liquid crystal capacitor, the waveform VCSBL_m is an oscillation voltage (i.e., a rectangular wave). The oscillation voltage VCSBL_m has an amplitude VCSpp and oscillates in a period that is shorter than one vertical scanning period.

When VGSL changes form Vg-L into Vg-H at a time T1, TFT_mn is turned ON. As a result, the voltage VSBLt1 on the source bus line SBL_n is transmitted to the pixel electrode PH_mn, thereby charging the liquid crystal capacitor CLC_mn and storage capacitor CCS_mn. Accordingly, the voltage VPH_mn applied to the pixel electrode PH_mn is $$VPH_mn=VSBLt1$$

Next, when the voltage on the gate bus line GBL_m changes from Vg-H into Vg-L at a time T2, TFT_mn is turned OFF, thereby electrically isolating the liquid crystal capacitor CLC_mn and storage capacitor CCS_mn from the source bus line SBL_n. Immediately after that, the voltage VPH_mn decreases by a feedthrough voltage Vd due to a parasitic capacitance produced by the active-matrix structure, for example, to become $$VPH_mn=VSBLt1-Vd$$

Next, at a time T3, the voltage VCSBL_m on the CS bus line CSBL_μm connected to the storage capacitor CCS_mn decreases by VCSpp. As a result, VPH_mn becomes $$VPH_mn=VSBLt1-Vd-K\times VCSpp$$

where K=CCS/(CLC+CCS).

Subsequently, at a time T4, the voltage VCSBL_μm increases by VCSpp. As a result, VPH_mn becomes $$VPH_mn=VSBLt1-Vd$$

Thereafter, at a time T5, the voltage VCSBL_μm decreases by VCSpp. As a result, VPH_mn becomes $$VPH_mn=VSBL(T1)-Vd-K\times VCSpp$$

Accordingly, between the times T3 and T4, VPH_mn is $$VPH_mn=VSBLt1-Vd-K\times VCSpp$$

and between the times T4 and T5, VPH_mn is $$VPH_mn=VSBLt1-Vd$$

The variation in the voltage VPH_mn between the times T3 and T5 will repeat itself a number of times until the pixel is updated next time (i.e., until it is a time corresponding to T1, or until one vertical scanning period has passed since T1). Thus, the oscillation voltage Vadd can be superposed on the voltage VPH_mn being applied to the pixel electrode PH_mn. Consequently, the effects of the present invention are achieved in an active-matrix-addressed LCD, too.

Next, the oscillation voltage to be superposed on the voltage being applied to the liquid crystal capacitor will be described.

The amplitude Vaddpp of the oscillation voltage Vadd superposed on the voltage VPH_mn being applied to the pixel electrode PH_mn is the difference between the voltage VPH_mn applied from the time T3 through the time T4 and the voltage VPH_mn applied from the time T4 through the time T5. Thus, the amplitude Vaddpp is:

$$Vaddpp=K\times VCSpp$$

The amplitude Vaddpp of the oscillation voltage Vadd superposed on the voltage VPH_mn being applied to the pixel electrode PH_mn is proportional to the amplitude VCSpp of the oscillation voltage VCSBL_m on the CS bus line CSBL_m. The voltage VCLC_mn=applied to the liquid crystal capacitor CLC_mn is obtained by subtracting the voltage VComLC at the liquid crystal capacitor counter electrode ComLC from the voltage VPH_mn at the pixel electrode PH_mn:

$$VCLC_mn=VPH_mn-VComLC$$

In this preferred embodiment, VComLC is defined to always have a constant voltage value irrespective of the time (as indicated by the dashed line in FIG. 9). Accordingly, the same oscillation voltage Vadd as that added to the pixel electrode voltage VPH_mn is also superposed on the voltage VCLC_mn applied to the liquid crystal capacitor CLC_mn. Thus, the amplitude Vaddpp of the oscillation voltage Vadd superposed on VCLC_mn is also $$Vaddpp=K\times VCSpp$$

Next, the average VCLCave_mn of the voltage VCLC_mn at the liquid crystal capacitor CLC_mn in one vertical scanning period will be described.

In a typical LCD, one horizontal scanning period (i.e., a period ranging from the time T1 through the time T3) is much shorter than one vertical scanning period. Also, in this preferred embodiment, the oscillation waveform of VCSBL_m is a rectangular wave with a duty cycle of 1:1. In view of these considerations, VPHave_mn is approximately equal to:

$$VPHave_mn=VSBLt1-Vd-K\times VCSpp/2$$

VPHave_mn depends on the amplitude VCSpp of the voltage VCSBL_m on the CS bus line CSBL_m.

Supposing VPHave_mn for a VCSpp of 0 volts is identified by VPHaveR_mn, VPHaveR_mn is given by:

$$VPHaveR_mn=VSBLt1-Vd$$

Thus, VPHave_mn is given by the following equation using VPHaveR_mn:

$$VPHave_mn=VPHaveR_mn-K\times VCSpp/2$$

The second term on the right side of this equation represents the variation in the average VPHave_mn of the pixel electrode voltage within one vertical scanning period when the pixel electrode voltage changes with VCSpp. That variation EVPHave_mn is obtained by:

$$EVPHave_mn=-K\times VCSpp/2$$

Accordingly, VPHave_mn can also be given by:

$$VPHave_mn=VPHaveR_mn+EVPHave_mn$$

where VPHaveR_mn=VSBLt1−Vd and EVPHave_mn=−K×VCSpp/2.

The voltage VCLC_mn applied to the liquid crystal capacitor CLC_mn is obtained by subtracting the voltage VComLC at the liquid crystal capacitor counter electrode ComLC from the voltage VPH_mn at the pixel electrode PH_mn. The voltage VComLC at the liquid crystal capacitor counter electrode ComLC always has a constant voltage value as indicated by the horizontal dashed line in FIG. 9. Accordingly, the average VCLCave_mn of the voltage VCLC_mn in one vertical scanning period is given by:

$$VCLCave_mn=VSBLt1-Vd-K\times VCSpp/2-VComLC$$

According to this equation, VCLCave_mn, as well as VPHave_mn, depends on the amplitude VCSpp of the oscillation voltage VCSBL_m on the CS bus line CSBL_m.

Supposing the VCLCave_mn value for a VCSpp of zero volts is identified by VCLCaveR_mn and the variation in VCLCave_mn with VCSpp is identified by EVCLCave_mn as in VPHave_mn, VCLCave_mn is also given by:

$$VCLCave_mn=VCLCaveR_mn+EVCLCave_mn$$

where VCLCaveR_mn=VSBLt1−Vd−VComLC and EVCLCave_mn=−K×VCSpp/2.

Next, it will be described how the average of the voltage applied to the liquid crystal capacitor CLC_mn within one vertical scanning period is affected by variations in the oscillation timing of the voltages on the gate bus line and CS bus line.

In the example shown in FIG. 9, at the time T3 (i.e., when the voltage on the CS bus line changes for the first time after the TFT has been turned OFF), the voltage VCSBL_m on the CS bus line decreases by VCSpp. Conversely, in the following example, the voltage on the CS bus line increases by VCSpp at that time T3. Supposing VCLCave_mn, VCLCaveR_mn, EVCLCave_mn and Vaddpp in the situation where the voltage VCSBL_m increases by VCSpp at the time T3 are identified by VCLCave*_mn, VCLCaveR*_mn, EVCLCave*_mn and Vaddpp*, respectively, VCLCave*_mn, VCLCaveR*_mn, EVCLCave*_mn and Vaddpp* are given by:

$$VCLCave^*_mn=VCLCaveR^*_mn+EVCLCave^*_mn$$

$$VCLCaveR^*_mn=VSBLt1-Vd-VComLC$$

$$EVCLCave^*_mn=K\times VCSpp/2$$

$$Vaddpp^*=K\times VCSpp$$

according to the previous description that was provided with reference to FIG. 9.

Comparing VCLCaveR_mn and EVCLCave_mn with VCLCaveR*_mn and EVCLCave*_mn, respectively, $$VCLCaveR_mn = VCLCaveR^*_mn$$

$$EVCLCave_mn \neq EVCLCave^*_mn$$

are satisfied. However, $$VCLCave_mn \neq VCLCave^*_mn$$

is also true.

Accordingly, the average of the voltage applied to the liquid crystal capacitor CLC_mn in one vertical scanning period changes with the CS bus line voltage VCSBL_m at the time T3.

Next, it will be briefly described how the amplitude of the oscillation voltage superposed on the voltage being applied to the liquid crystal capacitor is affected by the variations in oscillation timings of the voltages on the gate bus line and CS bus line.

Comparing Vaddpp with Vaddpp*, $$Vaddpp = Vaddpp^*$$

is satisfied. Thus, the amplitude of the oscillation voltage superposed on the voltage being applied to the liquid crystal capacitor remains the same no matter how the CS bus line voltage VCSBL_m changes at the time T3.

To sum up, according to the driving method that has just been described with reference to FIGS. 8 and 9 (more specifically, by using the CS bus line voltage as the oscillation voltage), an oscillation voltage can be superposed on the voltage being applied to a liquid crystal capacitor in an active-matrix-addressed LCD with TFTs. Also, as the oscillation voltage is superposed, the voltage being applied to the liquid crystal capacitor within a vertical scanning period changes its average. Furthermore, the average of the voltage being applied to the liquid crystal capacitor within a vertical scanning period changes according to the oscillation timings of the voltages on the gate bus line and CS bus line.

In the preferred embodiment described above, the operation of the active-matrix-addressed LCD has been described on only one liquid crystal capacitor CLC_mn and for just one vertical scanning period for the sake of simplicity. That is to say, the foregoing description just outlines how in principle the oscillation voltage Vadd is superposed on the voltage being applied to the single liquid crystal capacitor CLC_mn within a single vertical scanning period and how the average VCLCave_mn of the voltage being applied to the liquid crystal capacitor CLC_mn within the vertical scanning period changes as the oscillation voltage Vadd is superposed. It would be easy to find, just by reading this description, how to superpose the oscillation voltage on the voltage being applied to the liquid crystal capacitor in a plurality of pixels, multiple vertical scanning periods, or any of various inversion drive methods for use in a typical LCD. In that case, however, care must be taken such that the oscillation voltages to be superposed in a plurality of pixels or in multiple vertical scanning periods preferably have the same amplitude Vaddpp and the voltages being applied to the liquid crystal capacitor within the multiple vertical scanning periods preferably have the same average value VCLCave. This is because if these values changed from one pixel to another or every vertical scanning period, then a difference in luminance (i.e., uneven luminance or flicker) would be produced unintentionally.

According to the foregoing general description, to equalize Vaddpp, the source bus line voltage preferably has constant amplitude VCSpp from one pixel to another and every vertical scanning period.

On the other hand, to equalize the average voltage VCLCave from one pixel to another and every vertical scanning period, not only VCSpp needs to be constant but also the oscillation timings of the gate bus line voltage and CS bus line voltage have to be controlled appropriately. In oscillating the CS bus line voltage as a rectangular wave as shown in FIG. 9, the CS bus line voltage needs to change in the same direction, and EVCLCave_mn needs to have a constant value, at the time T3 shown in FIG. 9 in any pixel and in any vertical scanning period. In an active-matrix-addressed LCD in which write pixels are scanned in line by way of a gate bus line, each horizontal scanning period and the oscillation period of the CS bus line voltage need to follow a predetermined rule in order to satisfy that condition.

Hereinafter, the rule that every horizontal scanning period and the oscillation period of the CS bus line voltage need to follow will be described.

Figure 10:
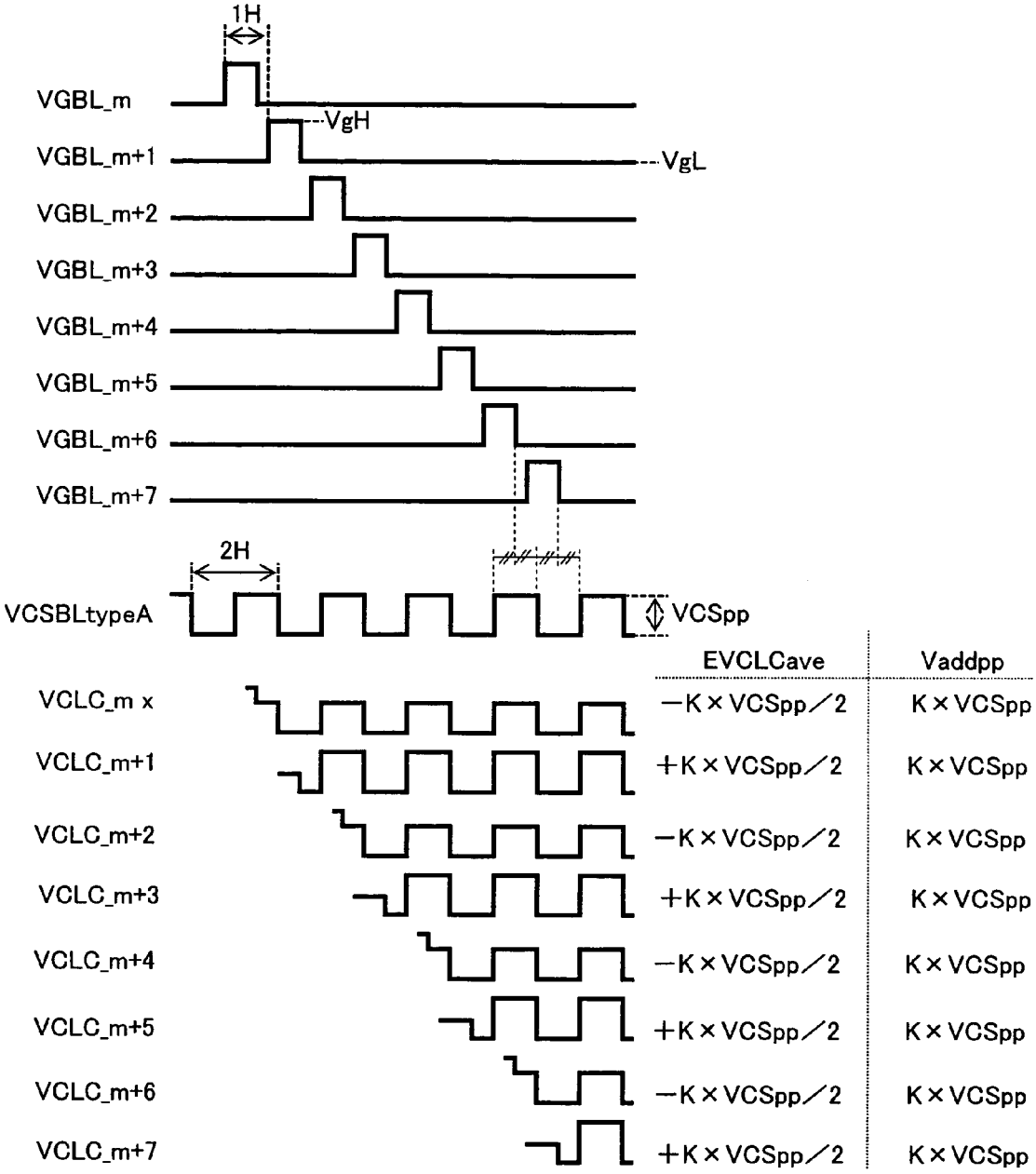
FIG. 10 shows, by way of gate bus line voltage waveforms, an exemplary CS bus line voltage (type A) and the voltage waveforms of the liquid crystal capacitors CLC for a number of rows, how the voltages VCLC being applied to the liquid crystal capacitors CLC change with the oscillation state of VCSBL.
Figure 11:
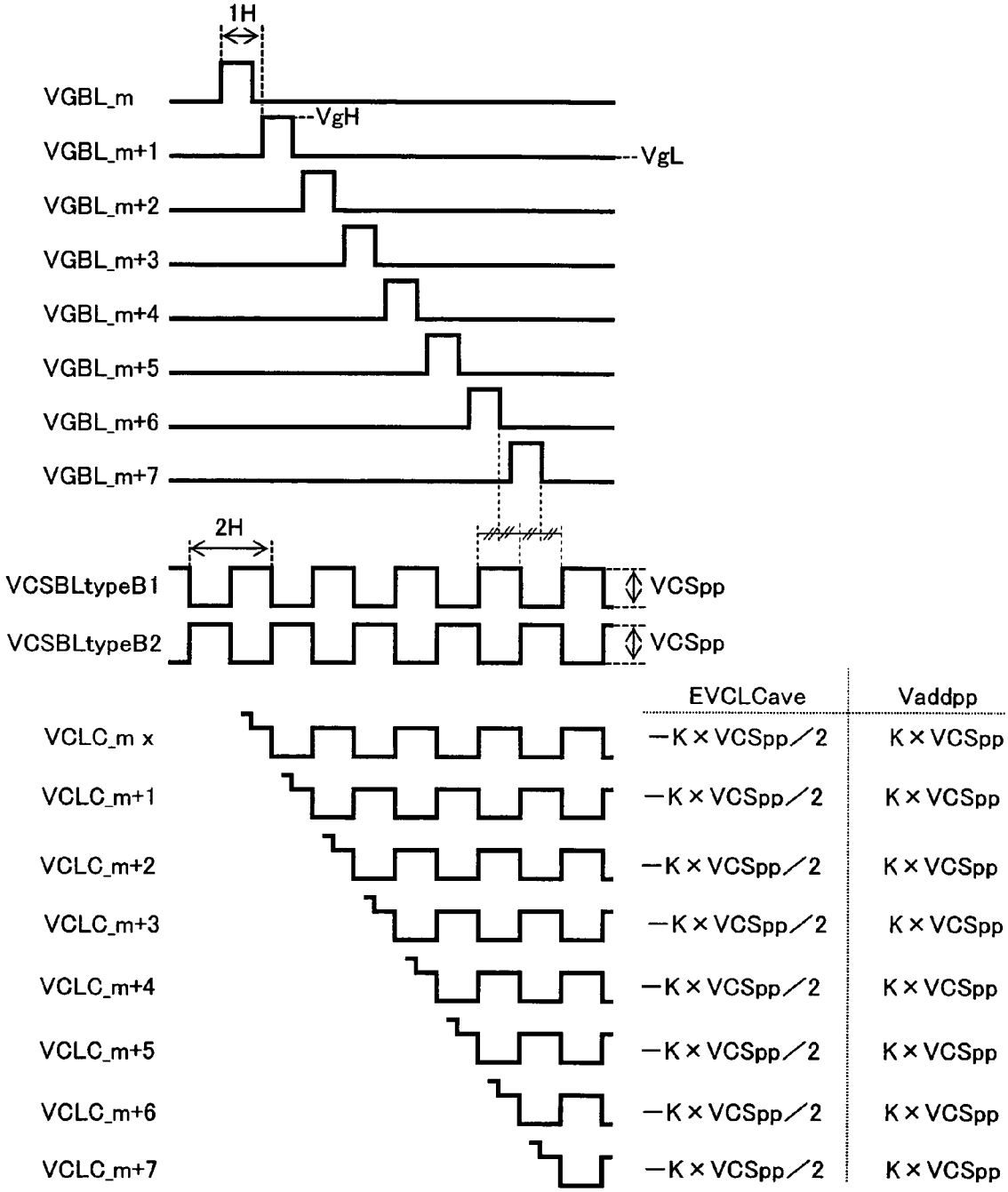
FIG. 11 shows, by way of gate bus line voltage waveforms, a pair of exemplary CS bus line voltages (types B1 and B2) and the voltage waveforms of the liquid crystal capacitors CLC for a number of rows, how the voltages VCLC being applied to the liquid crystal capacitors CLC change with the oscillation state of VCSBL.
Figure 12:
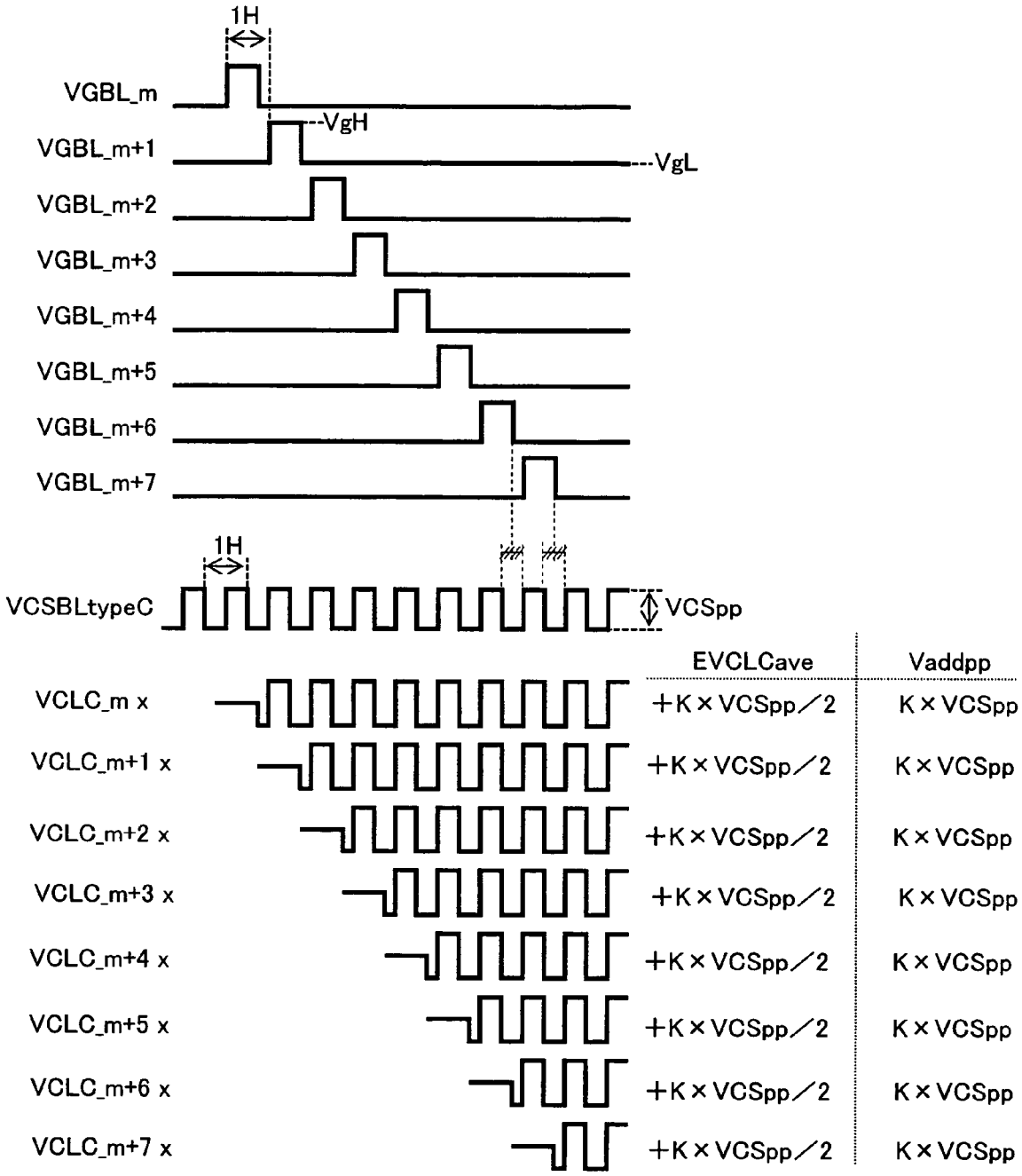
FIG. 12 shows, by way of gate bus line voltage waveforms, another exemplary CS bus line voltage (type C) and the voltage waveforms of the liquid crystal capacitors CLC for a number of rows, how the voltages VCLC being applied to the liquid crystal capacitors CLC change with the oscillation state of VCSBL.

FIGS. 10, 11 and 12 each schematically show how the voltage VCLC being applied to the liquid crystal capacitor CLC changes with the oscillation state of the CS bus line voltage VCSBL.

In each of these FIGS. 10, 11 and 12, the waveforms of gate bus line voltages VGBL are shown on a row-by-row basis from the $m^{th}$ row through $m+7^{th}$ row in the upper portion thereof, the waveform of the CS bus line voltage VCSBL is shown in the middle portion thereof, and the waveforms of the liquid crystal capacitor voltages VCLC associated with those gate bus line voltages VGBL are shown on a row-by-row basis in the lower portion thereof. On the right-hand side of the VCLC waveforms, respective EVCLC values are shown, and their associated Vaddpp values are also shown on the further right side.

In the example illustrated in FIG. 10, the same oscillation voltage VCSBLtypeA is applied to the CS bus line of every row. For example, the oscillation voltage VCSBLtypeA may be applied to the CS bus lines associated with the gate bus lines GBL_m, GBL_m+1, GBL_m+2, GBL_m+3, GBL_m+4, GBL_m+5, and GBL_m+6.

The oscillation voltage VCSBLtypeA has an oscillation period that is twice as long as one horizontal scanning period (i.e., 2H) and oscillation amplitude VCSpp. According to the description that provided with reference to FIG. 9, the phase of the VCSBLtypeA voltage waveform is preferably defined such that an arbitrary VGBL waveform changes from VgH into VgL synchronously with a flat portion of the VCSBLtypeA waveform. In the example illustrated in FIG. 10, in view of possible waveform disturbance resulting from manufacturing problems, each trailing edge of any VGBL waveform (i.e., a point in time when the VGBL waveform falls from VgH into VgL) is synchronized with a point in time between a leading edge and the next trailing edge of the VCSBLtypeA waveform or between a trailing edge and the next leading edge thereof.

In FIG. 10, at the time T3 (see FIG. 9), the oscillation voltage VCSBLtypeA changes in one direction (i.e., increases or decreases) on an even-numbered row (i.e., on the $m^{th}$, $m+2^{nd}$, $m+4^{th}$ and $m+6^{th}$ rows) and in the other direction (i.e., decreases or increases) on an odd-numbered row (i.e., on the $m+1^{st}$, $m+3^{rd}$, $m+5^{th}$ and $m+7^{th}$ rows). As a result, the VCLC waveform associated with an even-numbered row is different from that associated with an odd-numbered row.

More specifically, the VCLC voltage waveform associated with an even-numbered row decreases by K×VCSpp at a point in time corresponding to the time T3 and then oscillates by K×VCSpp every time one horizontal scanning period passes after that. On the other hand, the VCLC voltage waveform. associated with an odd-numbered row increases by K×VCSpp at the point in time corresponding to the time T3 and then oscillates by K×VCSpp every time one horizontal scanning period passes after that.

Accordingly, every even-numbered row has an EVCLC value of −K×VCSpp/2, while every odd-numbered row has an EVCLC value of +K×VCSpp/2. That is to say, these even- and odd-numbered rows have mutually different average voltages VCLCave applied to the liquid crystal capacitor.

That is to say, according to the driving method shown in FIG. 10, even if the luminance should be uniform all over the display screen, the luminance on even-numbered rows is different from that on odd-numbered rows, which is a problem.

This problem can be overcome by adopting the driving method shown in FIG. 11.

According to the driving method shown in FIG. 11, two CS bus line voltages VCSBLtypeB1 and VCSBLtypeB2 are alternately used from one CS bus line after another (i.e., on a row-by-row basis). More specifically, each even-numbered CS bus line (e.g., a CS bus line associated with a gate bus line GBL_m, GBL_m+2, GBL_m+4 or GBL_m+6) has the former voltage VCSBLtype1, while each odd-numbered CS bus line (e.g., a CS bus line associated with a gate bus line GBL_m+1, GBL_m+3, GBL_m+5 or GBL_m+7) has the latter voltage VCSBLtype2.

Each of the two CS bus line voltages VCSBLtypeB1 and VCSBLtypeB2 has an oscillation period that is twice as long as one horizontal scanning period (i.e., 2H). Also, the oscillation phase of VCSBLtypeB2 trails behind that of VCSBLtypeB1 by one horizontal scanning period (i.e., 1H). That is to say, the oscillation phase difference between VCSBLtypeB1 and VCSBLtypeB2 is 1H. As in FIG. 10, the gate bus line voltage waveforms and the oscillation phases of the respective CS bus line voltage waveforms are defined such that an arbitrary VGBL waveform changes from VgH into VgL synchronously with a flat portion of its associated CS bus line voltage waveform (preferably at the center of the flat portion).

The two CS bus line voltages VCSBLtypeB1 and VCSBLtypeB2 have the same oscillation amplitude VCSpp.

In the driving method shown in FIG. 11 in which the CS bus line voltages are defined as described above, the CS bus line voltage associated with each row decreases by VCSpp at a point in time corresponding to the time T3. Accordingly, each and every row has the same EVCLC value of −K×VCSpp/2, where K and VCSpp are constant values for every row.

Thus, according to the driving method shown in FIG. 11, the EVCLC value never changes row by row unlike the driving method that has been described with reference to FIG. 10.

Furthermore, in the driving method shown in FIG. 11, each and every row has the same Vaddpp value, too.

Consequently, according to the driving method shown in FIG. 11, the problem caused by the driving method shown in FIG. 10 can be overcome and the oscillation voltage can also be applied to the liquid crystal capacitor, thus achieving the effects of the present invention.

Likewise, as in the driving method shown in FIG. 11, the problem caused by the driving method shown in FIG. 10 can also be avoided and the effects of the present invention can also be achieved by the driving method shown in FIG. 12.

In the driving method shown in FIG. 11, the two different oscillation voltages VCSBLtypeB1 and VCSBLtypeB2 are used as the CS bus line voltages. In contrast, according to the driving method shown in FIG. 12, the effects of the present invention are achieved by using only one oscillation voltage VCSBLtypeC.

In the driving method shown in FIG. 12, the same CS bus line voltage VCSBLtypeC is applied to all CS bus lines.

The CS bus line voltage VCSBLtypeC has an oscillation period that is as long as one horizontal scanning period (i.e., 1H). The gate bus line voltage waveforms and the oscillation phase of the CS bus line voltage waveform are defined such that an arbitrary VGBL waveform changes from VgH into VgL synchronously with a flat portion of the CS bus line voltage waveform (preferably at the center of the flat portion).

The CS bus line voltage VCSBLtypeC also has the oscillation amplitude VCSpp.

In the driving method shown in FIG. 12, the CS bus line voltage associated with each row increases by VCSpp at a point in time corresponding to the time T3. Accordingly, each and every row has the same EVCLC value of +K×VCSpp/2, and also has the same Vaddpp value of K×VCSpp, too.

Consequently, according to the driving method shown in FIG. 12, the problem caused by the driving method shown in FIG. 10 can also be overcome and the effects of the present invention can also be achieved as in the driving method shown in FIG. 11.

In the driving method shown in FIG. 12, the same CS bus line voltage VCSBLtypeC is used for each and every CS bus line. That is to say, only a single oscillation voltage is applied to all CS bus lines. Accordingly, the oscillation voltage may be applied to the liquid crystal capacitor counter electrode, not to the CS bus lines. Thus, when the driving method shown in FIG. 12 is adopted, the effects of the present invention can also be achieved even by superposing the same oscillation voltage as the CS bus line voltage VCSBLtypeC on the voltage VComLC at the liquid crystal capacitor counter electrode ComLC.

Look at the signs of EVCLCave. In the preferred embodiment shown in FIG. 11, EVCLCave has negative sign (−). On the other hand, in the preferred embodiment shown in FIG. 12, EVCLC has positive sign (+). That is to say, according to the present invention, either negative sign or positive sign can be appropriately selected as the sign of EVCLCave. Nevertheless, EVCLCave preferably has positive sign because the effects of Vd shown in FIG. 9 can be canceled in that case.

However, in the active-matrix-addressed LCD shown in FIG. 8, the effects of the present invention are achieved not only by the driving method shown in FIG. 11 or 12 but also by any other appropriate driving method.

Hereinafter, the relationship between the number of electrically independent CS bus lines and the oscillation period of the oscillation voltage on the CS bus lines will be described.

In the driving method shown in FIG. 12, there is only one electrically independent CS bus line and its CS bus line voltage has an oscillation period that is as long as one horizontal scanning period (1H). On the other hand, in the driving method shown in FIG. 11, there are two electrically independent CS bus lines and their CS bus line voltages have an oscillation period that is twice as long as one horizontal scanning period (2H).

However, the relationship between the number of electrically independent CS bus lines and the oscillation period of the CS bus line voltages can be further expanded. For example, three electrically independent CS bus lines may be provided and the oscillation period of their CS bus line voltages may be three times as long as one horizontal scanning period (3H). Alternatively, four electrically independent CS bus lines may be provided and the oscillation period of their CS bus line voltages may be four times as long as one horizontal scanning period (4H). Speaking more generally, a number N of electrically independent CS bus lines may be provided and the oscillation period of their CS bus line voltages may be N times as long as one horizontal scanning period (NH).

In this case, those electrically independent CS bus lines need to be arranged so as to meet the following rules. For example, if three CS bus line voltages VCSBLtypeD1, VCSBLtypeD2 and VCSBLtypeD3 are used in an LCD in which CS bus lines are arranged in the order of CSBL_1, CSBL_2, CSBL_3, CSBL_4, CSBL_5, . . . , and CSBL_m from the top toward the bottom, then a first group of CS bus lines including CSBL_1, CSBL_4 and CSBL_7 needs to have the CS bus line voltage VCSBLtypeD1, a second group of CS bus lines including CSBL_2, CSBL_5 and CSBL_8 needs to have the CS bus line voltage VCSBLtypeD2, and a third group of CS bus lines including CSBL_3, CSBL_6 and CSBL_9 needs to have the CS bus line voltage VCSBLtypeD3. That is to say, three electrically independent groups of CS bus lines (i.e., the first group including CSBL_1, CSBL_4 and CSBL_7, the second group including CSBL_2, CSBL_5 and CSBL_8 and the third group including CSBL_3, CSBL_6 and CSBL_9) need to be provided.

On the other hand, if four CS bus line voltages VCSBLtypeE1, VCSBLtypeE2, VCSBLtypeE3 and VCSBLtypeE4 are used in the same LCD, then a first group of CS bus lines including CSBL_1, CSBL_5 and CSBL_9 needs to have the CS bus line voltage VCSBLtypeE1, a second group of CS bus lines including CSBL_2, CSBL_6 and CSBL_10 needs to have the CS bus line voltage VCSBLtypeE2, a third group of CS bus lines including CSBL_3, CSBL_7 and CSBL_11 needs to have the CS bus line voltage VCSBLtypeE3 and a fourth group of CS bus lines including CSBL_4, CSBL_8 and CSBL_12 needs to have the CS bus line voltage VCSBLtypeE4. That is to say, four electrically independent groups of CS bus lines (i.e., the first group including CSBL_1, CSBL_5 and CSBL_9, the second group including CSBL_2, CSBL_6 and CSBL_10, the third group including CSBL_3, CSBL_7 and CSBL_11 and the fourth group including CSBL_4, CSBL_8 and CSBL_12) need to be provided.

Furthermore, if a number N of CS bus line voltages VCSBLtypeF1, VCSBLtypeF2, VCSBLtypeF3, . . . and VCSBLtypeFN are used in the same LCD, then a first group of CS bus lines including CSBL_L, CSBL_N+1 and CSBL_2N+1 needs to have the CS bus line voltage VCSBLtypeF1, a second group of CS bus lines including CSBL_2, CSBL_N+2 and CSBL_2N+2 needs to have the CS bus line voltage VCSBLtypeF2, a third group of CS bus lines including CSBL_3, CSBL_N+3 and CSBL_2N+3 needs to have the CS bus line voltage VCSBLtypeF3 and an $N^{th}$ group of CS bus lines including CSBL_N, CSBL_2N and CSBL_3N needs to have the CS bus line voltage VCSBLtypeFN. That is to say, a number N of electrically independent groups of CS bus lines (i.e., the first group including CSBL_L, CSBL_N+1 and CSBL_2N+1, the second group including CSBL_2, CSBL_N+2 and CSBL_2N+2, the third group including CSBL_3, CSBL_N+3 and CSBL_2N+3 and the $N^{th}$ group including CSBL_N, CSBL_2N and CSBL_3N) need to be provided.

When a number of CS bus line voltages are used, the respective phases of those CS bus line voltages need to satisfy the following conditions, which are set to change the CS bus line voltage on every row in the same direction at the time T3 shown in FIG. 9 in any of the driving methods described above.

If the three CS bus line voltages VCSBLtypeD1, VCSBLtypeD2 and VCSBLtypeD3 are used, then the phases of the latter two CS bus line voltages VCSBLtypeD2 and VCSBLtypeD3 need to be delayed from that of the former CS bus line voltage VCSBLtypeD1 by one horizontal scanning period (1H) and two horizontal scanning periods (2H), respectively.

If the four CS bus line voltages VCSBLtypeE1, VCSBLtypeE2, VCSBLtypeE3 and VCSBLtypeE4 are used, then the phases of the latter three CS bus line voltages VCSBLtypeE2, VCSBLtypeE3 and VCSBLtypeE4 need to be delayed from that of the former CS bus line voltage VCSBLtypeE1 by one horizontal scanning period (1H), two horizontal scanning periods (2H), and three horizontal scanning periods (3H), respectively.

Generally speaking, if a number N of CS bus line voltages VCSBLtypeF1, VCSBLtypeF2, VCSBLtypeF3, . . . and VCSBLtypeFN are used, then the phases of the latter (N−1) CS bus line voltages VCSBLtypeF2, VCSBLtypeF3, . . . and VCSBLtypeFN need to be delayed from that of the former CS bus line voltage VCSBLtypeF1 by one horizontal scanning period (1H), two horizontal scanning periods (2H), . . . and (N−1) horizontal scanning periods ((N−1)H), respectively.

In any of these driving methods, each gate bus line voltage waveform preferably changes from VgH into VgL synchronously with the center of a flat portion of its associated CS bus line voltage waveform for the same reasons as those described with reference to FIGS. 11 and 12.

As can be seen from the foregoing description, by increasing the number of electrically independent CS bus lines, the oscillation voltage to be applied to each of those CS bus lines can have a longer period and the oscillation voltage generator can be fabricated more easily. However, as the number of electrically independent CS bus lines is increased, it becomes more and more difficult to make an LCD panel. Thus, the number of electrically independent CS bus lines is preferably defined appropriately in view of these considerations.

It should be noted that the effects of the present invention are achieved by not only the driving methods described above but also any other driving method. In the preferred embodiments described above, the voltage applied to the CS bus lines is a rectangular wave.

Nevertheless, the CS bus line voltage is preferably a rectangular wave. This is because even if the phase of the gate bus line voltage or CS bus line voltage has shifted due to some variation in the manufacturing process, the variation in EVCLCave can be minimized in that case. In the preferred embodiments described above, EVCLCave is described about a rectangular wave for the sake of simplicity and classified into the two situations depending on whether the CS bus line voltage increases or decreases at the time T3. In this case, EVCLCave depends on a constant K, which is defined by the capacitance value CLC of the liquid crystal capacitor or the capacitance value CCS of the storage capacitor, and on the oscillation amplitude VCSpp of the CS bus line voltage. However, the EVCLCave value is normally dependent on not only the K and VCSpp values but also a voltage difference between the CS bus line voltage when the gate bus line voltage decreases to VgL and the TFT turns OFF (i.e., a point in time corresponding to the time T2 shown in FIG. 9) and its average voltage in one vertical scanning period. That is to say, to make the EVCLCave value constant, the instant the TFT turns OFF (at the time T2 shown in FIG. 9), the voltage on its associated CS bus line is preferably made constant. This is why the EVCLCave value changes depending on whether the CS bus line voltage increases or decreases as described above. To minimize the variation in EVCLCave caused by a phase shift of the gate bus line voltage or CS bus line voltage due to some reason in the manufacturing process, the variation in CS bus line voltage around the time T2 is preferably reduced. In using a rectangular wave, by matching the time T2 with the flat portion of the waveform, the variation in EVCLCave caused by a phase shift of the gate bus line voltage or CS bus line voltage due to some reason in the manufacturing process can be minimized.

Next, an LCD according to another preferred embodiment of the present invention and a method for driving the LCD will be described.

In this preferred embodiment, the voltage waveform of the oscillation voltage applied to each CS bus line has at least three potentials, which include two potentials that define the maximum amplitude of the oscillation voltage (i.e., Vaddpp in the driving method of the preferred embodiment described above), and another potential equal to the average potential of the oscillation voltage. In this case, the "average potential of the oscillation voltage" does not always refer to a simple average of the two potentials that define the maximum amplitude of the oscillation voltage but to an "effective average" of the oscillation voltage. That is to say, when the "effective average" is defined for one period of the oscillation voltage waveform, the total area of waveform portions above the effective average should be equal to that of the other waveform portions below the effective average. In the following example, the oscillation voltage has a waveform that is symmetric to the centerline of the two potentials defining the maximum amplitude of the oscillation voltage, and therefore, the simple average of those two potentials defining the maximum amplitude of the oscillation voltage happens to be equal to the effective average of the oscillation voltage. Also, in a period of time in which the oscillation voltage has a potential that is equal to the average potential of the oscillation voltage waveform (i.e., in the flat portion), TFTs, belonging to the pixels that are connected to the CS bus line to which that oscillation voltage is applied, are turned OFF. In the following example, the instant the gate bus line voltage decreases to VgL to turn OFF the TFTs (corresponding to the time T2 shown in FIG. 9) is in the middle of the period in which the oscillation voltage has the average potential. In the following preferred embodiment, the oscillation voltage waveform includes the three potentials described above. However, the oscillation voltage waveform may include more than three potentials (e.g., five, seven or nine potentials) as well.

In this preferred embodiment, the oscillation voltage can be superposed on the voltage being applied to the liquid crystal capacitor without changing the average value of the voltage being applied to the liquid crystal capacitor. That is to say, constant Vaddpp can be obtained with EVCLCave kept equal to zero. As a result, compared to the situation where the driving method shown in FIGS. 10 through 12 is adopted, the reliability can be increased. The reasons will be described below.

Generally speaking, an electrical load, consisting of the parasitic capacitance of a CS bus line and a bus line resistance thereof, changes its value depending on the on-screen location in an LCD. The effective waveform of the oscillation voltage applied to a CS bus line is rounded as being affected by the electrical load. Thus, its (effective) amplitude also changes depending on the on-screen location. Accordingly, in the LCD of the previous embodiment shown in FIGS. 11 and 12, if the average of the voltage applied to the liquid crystal capacitor depends on the (effective) amplitude of the oscillation voltage applied to the CS bus line, then the average of the voltage applied to the liquid crystal capacitor also changes depending on the on-screen location. In that case, the voltage applied to the liquid crystal layer cannot have zero DC components everywhere on the display screen and the counter voltage cannot be regulated to its optimum value, either, everywhere on the display screen. If such an LCD, in which the voltage applied to the liquid crystal layer does not always have zero DC components, were used for a long time, then the liquid crystal material, alignment film material or any other material of the LCD would be damaged so much as to decrease the display quality of the LCD significantly. In contrast, in the LCD of this preferred embodiment, the average of the voltage applied to the liquid crystal capacitor never depends on the (effective) amplitude of the oscillation voltage applied to the CS bus line, thus causing no such problems concerning the reliability of the LCD.

On the other hand, according to the foregoing description, the oscillation voltage component to be superposed on the voltage being applied to the liquid crystal layer, i.e., Vaddpp, also changes depending on the on-screen location in the LCD. Even so (i.e., even if the oscillation voltage component changes with the on-screen location), the display quality is not affected so seriously. The reasons will be described later.

The oscillation voltage component to be superposed on the voltage being applied to the liquid crystal layer, i.e., Vaddpp, contributes to improving the gray-scale voltage dependence of the luminance shown in FIG. 5. If the magnitude of the oscillation voltage component changed depending on the on-screen location in the LCD, then only the degree of that improvement would change according to the on-screen location. That is to say, the reliability of the LCD would not be affected at all unlike the LCD described above. Furthermore, the variation in the degree of improvement according to the on-screen location depends on the variation in the electrical load of the CS bus line. Thus, that variation appears just as a slow and continuous gradational change, which is hard to recognize with the eyes. That is to say, the display quality is affected to an extremely small degree if ever.

Hereinafter, that preferred embodiment of the present invention will be described more specifically in comparison with the preferred embodiment shown in FIGS. 10, 11 and 12.

Figure 13:
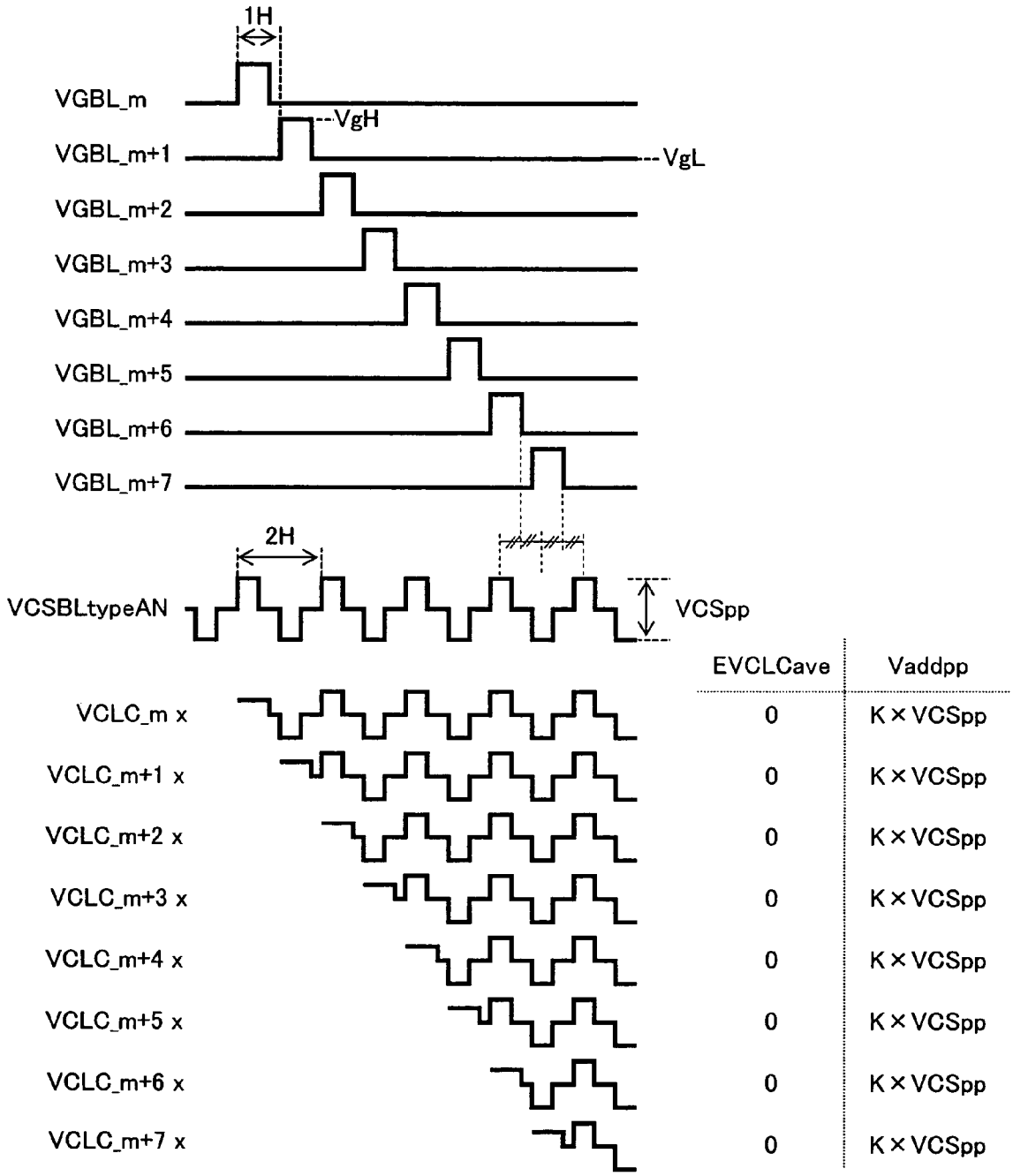
FIG. 13 shows, by way of gate bus line voltage waveforms, an exemplary CS bus line voltage (type AN) and the voltage waveforms of the liquid crystal capacitors CLC for a number of rows, how the voltages VCLC being applied to the liquid crystal capacitors CLC change with the oscillation state of VCSBL.
Figure 14:
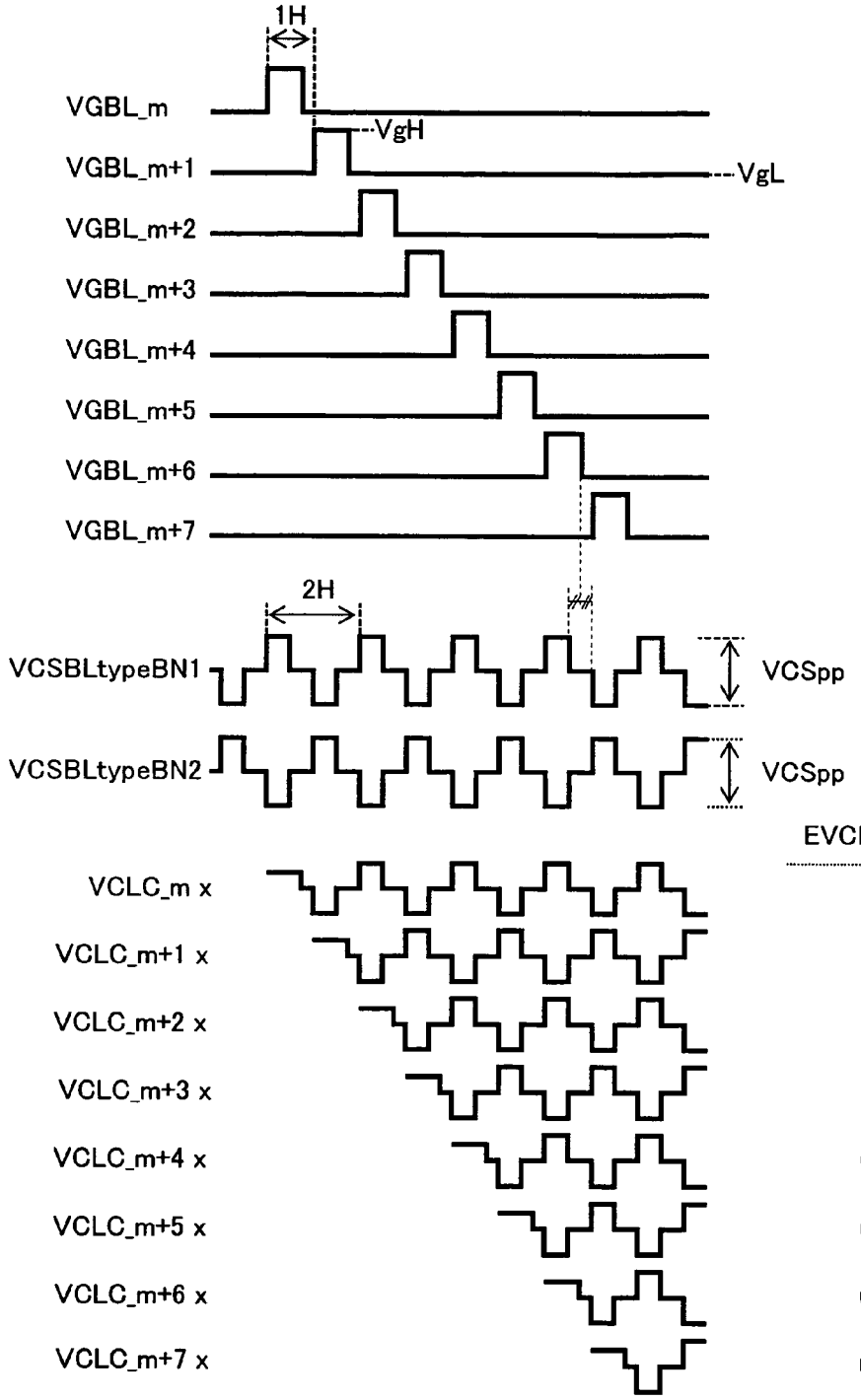
FIG. 14 shows, by way of gate bus line voltage waveforms, a pair of exemplary CS bus line voltages (types BN1 and BN2) and the voltage waveforms of the liquid crystal capacitors CLC for a number of rows, how the voltages VCLC being applied to the liquid crystal capacitors CLC change with the oscillation state of VCSBL.
Figure 15:
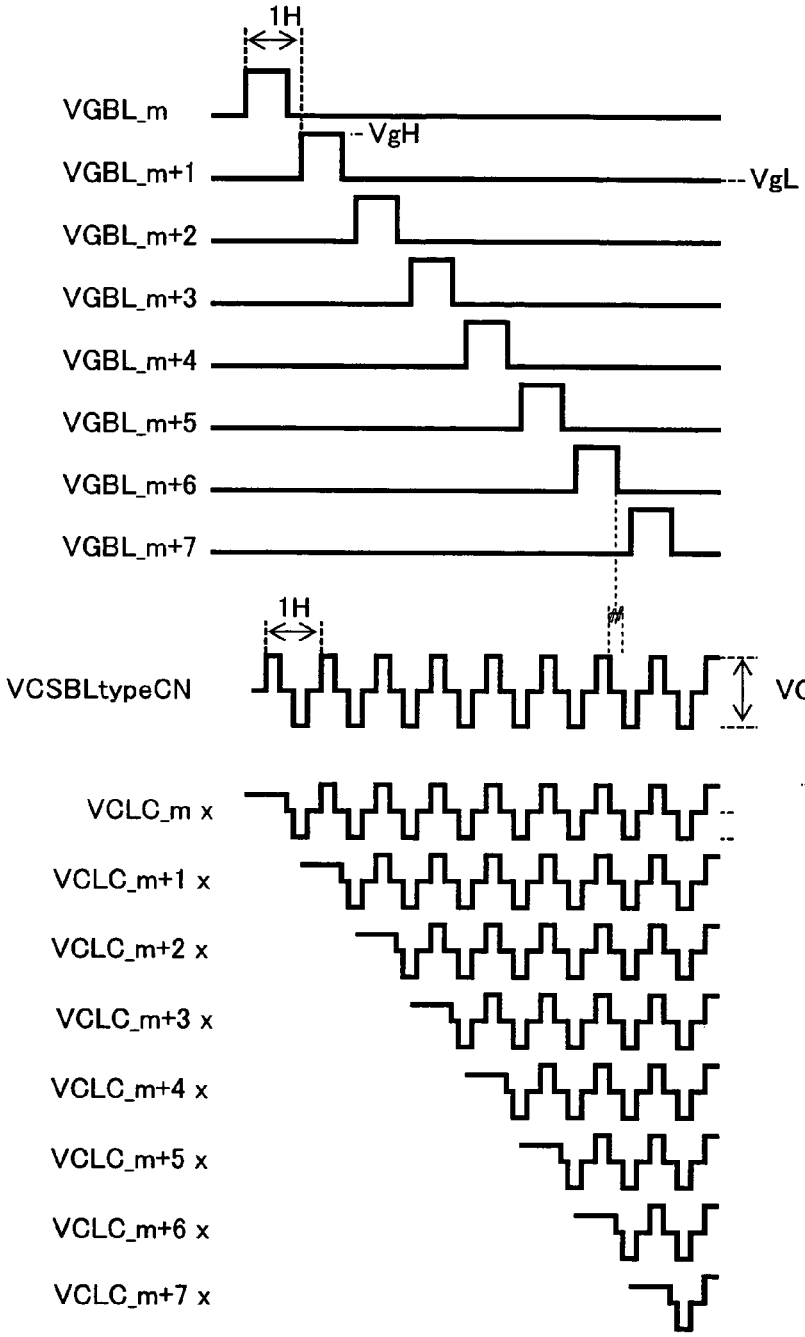
FIG. 15 shows, by way of gate bus line voltage waveforms, another exemplary CS bus line voltage (type CN) and the voltage waveforms of the liquid crystal capacitors CLC for a number of rows, how the voltages VCLC being applied to the liquid crystal capacitors CLC change with the oscillation state of VCSBL.

In this preferred embodiment, the oscillation voltages VCSBLtypeA, VCSBLtypeB1, VCSBLtypeB2 and VCSBLtypeC to be applied to the CS bus lines in the preferred embodiment shown in FIGS. 10, 11 and 12 are replaced with oscillation voltages VCSBLtypeAN, VCSBLtypeBN1, VCSBLtypeBN2 and VCSBLtypeCN, respectively, with the features of this preferred embodiment. FIGS. 13, 14 and 15 respectively correspond to FIGS. 10, 11 and 12 for the preferred embodiment described above.

As shown in FIGS. 13, 14 and 15, the voltage waveform of the oscillation voltage applied to each CS bus line includes two potentials that define the maximum amplitude Vaddpp of the oscillation voltage and another potential equal to the average potential of the oscillation voltage. Also, just in the middle of the period of time in which the oscillation voltage has a potential that is equal to the average potential of the oscillation voltage waveform (i.e., in the flat portion), TFTs, belonging to the pixels connected to the CS bus line to which that oscillation voltage is applied, are turned OFF.

In any of the examples shown in FIGS. 13, 14 and 15, EVCLCave=0 and Vaddpp=K×VCSpp. That is to say, the oscillation voltage can be superposed on the voltage being applied to the liquid crystal capacitor without changing the average of the voltage being applied to the liquid crystal capacitor.

Among other things, in the preferred embodiment shown in FIG. 13 corresponding to the example shown in FIG. 10, the problem of the example shown in FIG. 10 that the average of the voltage being applied to the liquid crystal capacitor changes on a row-by-row basis (i.e., each pair of odd- and even-numbered rows has mutually different EVCLCave values) can be overcome.

In this preferred embodiment, the same statement as that already described for the previous preferred embodiments also applies to the relationship between the number of electrically independent CS bus lines and their oscillation period. That is to say, if there are N types of electrically independent CS bus lines, the oscillation period can be N times as long as one horizontal scanning period of the CS bus lines.

In this case, the number of those electrically independent CS bus lines is preferably an even number. And if the oscillation voltage waveform of an arbitrary one of the CS bus lines changes in one direction at a certain point in time, there should be another CS bus line of which the oscillation voltage waveform changes in the opposite direction but to the same degree at that point in time. Also, the number of CS bus lines to which one of these two voltages is applied is preferably equal to that of CS lines to which the other voltage is applied. That is to say, as can be seen from the preferred embodiment shown in FIG. 14, if there is an oscillation voltage of one phase on an arbitrary CS bus line, another oscillation voltage of the reverse phase (i.e., of which the phase is shifted from the former phase by 180 degrees) is preferably applied to another CS bus line. In the previous embodiment described above, the example shown in FIG. 11 is most preferred. The reasons are as follows.

In general, the counter electrode of an LCD is connected to a reference potential (e.g., a counter electrode potential) by way of a finite electrical resistance. Accordingly, when the oscillation voltage is applied to the CS bus line, the potential at the counter electrode changes with the oscillation voltage. As a result, the CS bus line oscillation voltage may not be transmitted to the liquid crystal capacitor or storage capacitor efficiently because the oscillation voltage is consumed to oscillate the potential at the counter electrode. In contrast, if there are an oscillation voltage of one phase on a CS bus line and another oscillation voltage of the reverse phase (i.e., which is shifted from the former phase by 180 degrees), then the variation in the potential at the counter electrode can be minimized. Consequently, the CS bus line oscillation voltage can be transmitted to the liquid crystal capacitor or storage capacitor efficiently.

In any of the preferred embodiments described above, the CS bus line voltage is a rectangular wave. By using the rectangular wave, the advantages described above are achieved but the following problems are caused, too.

For example, when the voltage applied to a CS bus line is a rectangular wave, a lot of current flows through the CS bus line instantaneously. In general, the amount of current flowing when an oscillation voltage is applied to an electrostatic capacitor is proportional to the time differential of the voltage. In a rectangular wave, when the voltage changes (e.g., at the time T4 or T5 shown in FIG. 9), the voltage has an enormous time differential value (or infinity in an ideal rectangular wave) and a huge amount of current flows at that moment. To avoid this problem, a waveform in which the voltage variation has a small time differential value (e.g., a sine wave) is preferably used. However, if an oscillation voltage with three or more potentials is used as shown in FIGS. 13, 14 and 15, at least the potential equal to the average of the oscillation voltage is preferably kept constant (i.e., has a flat portion) for a predetermined amount of time.

The waveform of the CS bus line voltage is appropriately defined (e.g., as a rectangular wave with rounded edges (rectangular wave that has been passed through a low pass filter) or a sine wave) in view of these advantages and disadvantages caused by the use of such a rectangular wave.

In the preferred embodiments described above, a predetermined gray-scale voltage is applied as it is to a pixel electrode. However, the present invention is in no way limited to those specific preferred embodiments. For example, even if an overshoot voltage, as well as the gray-scale voltage, is applied to improve the response speed of the liquid crystal layer, the effects of the present invention are also achieved.

Various preferred embodiments of the present invention described above provide a liquid crystal display device that can present an image of quality with the unevenness of display minimized and also provide a liquid crystal display device that can be driven with a reduced applied voltage because the threshold voltage of its electro-optic characteristic can be decreased.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

What is claimed is:

1. A liquid crystal display device comprising a plurality of pixels, each of which includes a liquid crystal capacitor made up of a liquid crystal layer and two electrodes to apply a voltage to the liquid crystal layer, wherein each said pixel further includes a storage capacitor, and wherein the liquid crystal capacitor includes a pixel electrode, which is provided for each said pixel, and a counter electrode, which is provided for all of the pixels in common electrically; and wherein the storage capacitor includes a first electrode, which is electrically connected to the pixel electrode, an insulating layer, and a second electrode, which faces the first electrode with the insulating layer interposed between the first and second electrode, and the second electrode is electrically independent from the counter electrode; and wherein while the device is conducting a display operation, an oscillation voltage, which oscillates a number of times within a single vertical scanning period, is applied to the second electrode such that the oscillation voltage is superposed to a voltage of the pixel electrode, and the oscillation voltage and a predetermined gray-scale voltage are applied to the liquid crystal capacitor of an arbitrary one of the pixels, wherein in an arbitrary vertical scanning period, the respective second electrodes of all pixels belonging to an arbitrary one of the rows are electrically connected together, wherein the oscillation voltage includes a first oscillation voltage and a second oscillation voltage which is different from the first oscillation voltage, the first oscillation voltage and the second oscillation voltage having a phase difference of 180 degrees, wherein in the arbitrary vertical scanning period, the first oscillation voltage is applied to the respective second electrodes of all pixels belonging to one of two mutually adjacent rows via a first CS bus line, and the second oscillation voltage is applied to the respective second electrodes of all pixels belonging to the other row via a second CS bus line, the first and second oscillation voltages being applied concurrently, wherein the first and second CS bus lines are parallel to a plurality of scan lines.

2. The liquid crystal display device of claim 1, wherein the first and second oscillation voltages both have a period corresponding to two horizontal scanning periods, and have the same amplitude.

3. The liquid crystal display device of claim 1, wherein in the arbitrary vertical scanning period, the first and second oscillation voltages applied to the respective second electrodes of the pixels change every m consecutive rows.

4. The liquid crystal display device of claim 3, wherein each of the periods of the first and second oscillation voltages, which also changes every m consecutive rows, is m times as long as one horizontal scanning period and has the same amplitude.

5. The liquid crystal display device of claim 1, further comprising a TFT, which is provided for each said pixel, and a gate bus line and a source bus line, which are connected to each TFT, and wherein the respective second electrodes of the pixels belonging to the arbitrary row are connected to the gate bus line associated with the row.

6. The liquid crystal display device of claim 1, wherein the pixels are arranged in columns and rows, and wherein the liquid crystal display device further includes: a TFT, which is provided for each said pixel; a gate bus line and a source bus line, which are connected to each TFT; and a plurality of CS bus lines, each of which connects together the respective second electrodes of pixels belonging to an associated one of the rows, and wherein in the CS bus lines, there are an even number of electrically independent CS bus lines.

7. The liquid crystal display device of claim 1, wherein an voltage waveform of the oscillation voltage includes at least three potentials including two potentials that define maximum amplitude and another potential equal to an average potential.

8. The liquid crystal display device of claim 1, wherein supposing the storage capacitor has a capacitance CCS, the liquid crystal capacitor has a minimum capacitance CLC_min and an electro-optic characteristic of the liquid crystal layer has a threshold voltage Vth, the effective value of the oscillation voltage is at least one-tenth of, and at most equal to, $Vth \cdot \{(CCS+CLC_min)/CCS\}$.

9. The liquid crystal display device of claim 1, wherein the effective value of the oscillation voltage is at least one-tenth of, and at most equal to, the electro-optic threshold voltage Vth of the liquid crystal layer.

10. The liquid crystal display device of claim 1, wherein the first and second oscillation voltages oscillate in a period that is an integral number of times as long as one horizontal scanning period.

11. The liquid crystal display device of claim 1, wherein the liquid crystal display device conducts a display operation in normally black mode.

12. The liquid crystal display device of claim 1, wherein a CS bus line voltage associated with each row decreases by an amplitude of the first and second oscillation voltages starting at a specific time.

* * * * *